US007868849B2

(12) United States Patent
Jung et al.

(10) Patent No.: US 7,868,849 B2
(45) Date of Patent: Jan. 11, 2011

(54) PLASMA DISPLAY APPARATUS AND METHOD OF DRIVING THE SAME

(75) Inventors: Yun Kwon Jung, Gumi-si (KR); Hee Chan Yang, Busan (KR); Jin Young Kim, Daegu (KR)

(73) Assignee: LG Electronics Inc., Seoul (KR)

( * ) Notice: Subject to any disclaimer, the term of this patent is extended or adjusted under 35 U.S.C. 154(b) by 1055 days.

(21) Appl. No.: 11/157,976

(22) Filed: Jun. 22, 2005

(65) Prior Publication Data

US 2006/0103593 A1 May 18, 2006

(30) Foreign Application Priority Data

Nov. 16, 2004 (KR) ..... 10-2004-0093725

(51) Int. Cl.
*G09G 3/28* (2006.01)

(52) U.S. Cl. ..... 345/60; 345/204; 313/484; 340/815.4; 37/41

(58) Field of Classification Search ..... 345/60, 345/87, 204
See application file for complete search history.

(56) References Cited

U.S. PATENT DOCUMENTS 6,414,658 B1 * 7/2002 Tokunaga ..... 345/63
6,417,824 B1 7/2002 Tokunaga et al.
6,661,395 B2 * 12/2003 Lo et al. ..... 345/60
2001/0024179 A1 * 9/2001 Nakamura ..... 345/60
2002/0175906 A1 * 11/2002 Moon ..... 345/204

FOREIGN PATENT DOCUMENTS

| | | |
|---|---|---|
| EP | 0853306 A1 | 7/1998 |
| EP | 1365382 A1 | 11/2003 |
| JP | 08305319 | 11/1996 |
| JP | 10-091117 | 4/1998 |
| JP | 2000-242227 | 9/2000 |
| JP | 2001-272948 | 10/2001 |
| JP | 2002-093136 | 3/2002 |
| JP | 2006-064827 | 3/2006 |
| KR | 10-2001-0046334 | 6/2001 |

* cited by examiner

*Primary Examiner*—Sumati Lefkowitz
*Assistant Examiner*—Grant D Sitta
(74) *Attorney, Agent, or Firm*—McKenna Long & Aldridge LLP

(57) ABSTRACT

In the method of driving a plasma display panel according to the present invention, the address electrodes are divided into a plurality of electrode groups, and the an application time point of data pulses applied to one or more of the address electrode groups in the address period is different from that of a scan pulse applied to the scan electrode in all the sub-fields of the frame. In addition, the width of the scan pulse applied during an address period of a predetermined number of the sub-fields is greater than the width of scan pulses applied during the address period of the remaining sub-fields.

6 Claims, 24 Drawing Sheets

PLASMA DISPLAY APPARATUS AND METHOD OF DRIVING THE SAME

This application claims the benefit of Korean Patent Application No. 10-2004-0093725, filed on Nov. 16, 2004, which is hereby incorporated by reference for all purposes as if fully set forth herein.

BACKGROUND OF THE INVENTION

1. Field of the Invention

The present invention relates to a plasma display panel, and more particularly, to a plasma display panel and method of driving same, wherein the application time point and width of a pulse applied during the address period of a sub-field are improved to reduce noise and prevent degradation of jitter characteristics.

2. Background of the Related Art

Generally, in a plasma display panel, barrier ribs formed between a front substrate and a rear substrate form unit or discharge cells. Each of the cells is filled with a main discharge gas, such as neon (Ne), helium (He), or a mixture of Ne and He, and an inert gas containing a small amount of xenon. When it is discharged by a high frequency voltage, the inert gas generates vacuum ultraviolet rays, which thereby cause phosphors formed between the barrier ribs to emit light, thus displaying an image. Because the plasma display panel can be made with a thin and/or slim form, it has attracted attention as a next-generation display device.

FIG. 1 is a perspective view illustrating the configuration of a conventional plasma display panel. As shown in FIG. 1, the plasma display panel includes a front substrate 100 and a rear substrate 110 disposed parallel to each other with a gap in-between. The front substrate 100 has a plurality of electrode pairs arranged on a front glass 101, which serves as the display surface. Each electrode pair is formed of a scan electrode 102 and a sustain electrode 103. The rear substrate 110 is provided with a plurality of address electrodes 113 arranged on a rear glass 111, which constitutes a rear surface. The address electrode 113 is formed so as to cross the electrode pairs 102 and 103.

Both the scan electrode 102 and the sustain electrode 103 are formed of a transparent electrode "a" made of a transparent ITO material and a bus electrode "b" made of a metallic material. The scan electrode 102 and the sustain electrode 103 are covered with one or more upper dielectric layers 104 to limit discharge current and provide insulation among the electrode pairs. A protection layer 105 having magnesium oxide (MgO) deposited thereon in order to facilitate a discharge condition is formed on top of the upper dielectric layer 104.

In the rear substrate 110, barrier ribs 112 are arranged in the form of a stripe pattern (or a well type) such that a plurality of discharge spaces or discharge cells are formed in parallel. Furthermore, a plurality of address electrodes 113 for performing an address discharge to generate vacuum ultraviolet rays are disposed parallel to the barrier ribs 112. The top surface of the rear substrate 110 is coated with R, G, and B phosphors 114 for emitting visible rays for an image display when an address discharge is carried out. A lower dielectric layer 115 is formed between the address electrodes 113 and the phosphors 114 for protecting the address electrodes 113.

The plasma display panel includes a plurality of discharge cells in a matrix formation, and is provided with a driving module (not shown) having a driving circuit for supplying a predetermined pulse to the discharge cells. The interconnection between the plasma display panel and the driving module is illustrated in FIG. 2.

As illustrated in FIG. 2, the driving module includes, for example, a data driver integrated circuit (IC) 20, a scan driver IC 21, and a sustain board 23. The data driver IC 20 supplies a data pulse to the plasma display panel 22 after an image signal is processed. Also, the plasma display panel receives a scan pulse and a sustain pulse output from the scan driver IC 21 and a sustain signal output from the sustain board 23. A discharge is generated in a cell selected by the scan pulse among the plurality of the cells included in the plasma display panel 22, which has received the data pulse, the scan pulse, the sustain pulse, and the like. The cell where discharge has occurred emits light with a predetermined brightness. The data driver IC 20 outputs a predetermined data pulse to each of the address electrodes $X_1$ to $X_n$ through a connector such as a FPC (Flexible Printed Circuit) (not shown). In this case, the X electrodes refer to the data electrodes.

FIG. 3 illustrates a method for implementing image gradation or gray scale in a conventional plasma display panel. As illustrated in FIG. 3, a frame is divided into a plurality of sub-fields having a different number of emission times. Each sub-field is subdivided into a reset period (RPD) for initializing all the cells, an address period (APD) for selecting the cell(s) to be discharged, and a sustain period (SPD) for implementing the gray scale according to the number of discharges. For example, if an image with 256 gradation levels is to be displayed, the frame period (for example, 16.67 ms) corresponding to 1/60 second is divided into eight sub-fields SF1 to SF8, and each of the eight sub-fields SF1 to SF8 are subdivided into a reset period, an address period and a sustain period, as illustrated in FIG. 3.

The reset and address period is the same for every sub-field. However, the sustain period increases by a ratio of $2^n$ (where, n=0, 1, 2, 3, 4, 5, 6, 7) for each sub-field SF1 to SF8, as shown in FIG. 3. Since the sustain period varies from one sub-field to the next, a specific grey level is achieved by controlling which sustain periods are to be used for discharging each of the selected cells, i.e., the number of the sustain discharges that are realized in each of the discharge cells.

FIG. 4 illustrates a driving waveform according to a conventional method for driving a plasma display panel. As shown, during a given sub-field, the waveforms associated with the X, Y, and Z electrodes are divided into a reset period for initializing all the cells, an address period for selecting the cells to be discharged, a sustain period for maintaining discharging of the selected cells, and an erase period for eliminating wall charges within each of the discharge cells.

The reset period is further divided into a set-up and set-down period. During the set-up period, a ramp-up waveform (Ramp-up) is applied to all the scan electrodes at the same time. This results in wall charges of a positive polarity being built up on the address electrodes and the sustain electrodes, and wall charges of a negative polarity being built up on the scan electrodes.

During the set-down period, a ramp-down waveform (Ramp-down), which falls from a positive polarity voltage lower than the peak voltage of the ramp-up waveform to a given voltage lower than a ground level voltage is applied to all the scan electrode at the same time, causing a weak erase discharge within the cells. Furthermore, the remaining wall charges are uniform inside the cells to the extent that the address charge can be stably performed.

During the address period, a scan pulse with a negative polarity is applied sequentially to the scan electrodes, and a data pulse with a positive polarity is selectively applied to specific address electrodes in synchronization with the scan pulse. As the voltage difference between the scan pulse and the data pulse is added to the wall voltage generated during the reset period, an address discharge is generated in the cells to which the data pulse is applied. A wall charge is formed inside the selected cells such that when a sustain voltage Vs is applied a discharge occurs. A positive polarity voltage Vz is applied to the sustain electrodes so that erroneous discharge does not occur with the scan electrode by reducing the voltage difference between the sustain electrodes and the scan electrodes during the set-down period and the address period.

During the sustain period, a sustain pulse is alternately applied to the scan electrodes and the sustain electrodes. Every time a sustain pulse is applied, a sustain discharge or display discharge is generated in the cells selected during the address period.

Finally, during the erase period, (i.e., after the sustain discharge is completed) an erase ramp waveform (Ramp-ers) having a small pulse width and a low voltage level, is applied to the sustain electrodes to erase the remaining wall charges within all the cells.

As discussed above, during the address period the scan pulses and data pulses have the same application time point (i.e., the pulses are applied to the respective electrodes at the same point in time). As illustrated in FIG. 5, according to the conventional driving method, a data pulse is applied to the address electrodes $X_1$ to $X_n$, at the same time ts that a scan pulse is applied to the scan electrodes. However, when the data pulse and the scan pulse are applied at the same time, noise occurs in the waveforms applied to the scan and sustain electrodes, as illustrated in FIG. 6.

This noise is generated due to coupling through the capacitance of the panel. As illustrated in FIG. 6, noise is generated in the waveforms applied to the scan electrodes and the sustain electrodes at the leading and trailing edges of the data pulse, i.e., when the data pulse abruptly rises and falls. This noise causes the address discharge to become unstable, thereby degrading the driving efficiency of a plasma display panel.

SUMMARY OF THE INVENTION

Accordingly, the present invention is directed to plasma display apparatus and method of driving same that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purposes of the present invention, as embodied and broadly described, a method for driving a plasma display panel is provided that comprises dividing the plurality of address electrodes into a plurality of address electrode groups; applying a scan pulse to the scan electrode during an address period of a plurality of sub-fields; applying a data pulse to each of the plurality of address electrode groups in association with a scan pulse, wherein an application time point for at least one of the plurality of address electrode groups is difference from that of the other address electrode groups during an address period of at least one of sub-field; wherein the width of a scan pulse applied during an address period of a predetermined number of the plurality of sub-fields is greater than the width of a scan pulse applied during an address period of the remaining sub-fields In another aspect of the present invention a plasma display apparatus is provided that comprises: a scan electrode; a plurality of address electrodes, the plurality of address electrodes crossing the scan electrode; a scan driver for driving the scan electrode; a data driver for driving the plurality of address electrodes; and a controller configured to: apply a scan pulse to the scan electrode during an address period of a plurality of sub-fields within a frame; and apply a data pulse to each of a plurality of data electrode groups in association with a scan pulse, wherein an application time point for at least one of the plurality of data electrode groups is different from that of the other data electrode groups during an address period of at least one sub-field of said plurality of sub-fields, where each of the plurality of data electrode groups includes one or more address electrodes; wherein the width of the scan pulse applied during an address period of a predetermined number of the plurality of sub-fields is greater than the width of a scan pulse applied during an address period of the remaining sub-fields.

In still another aspect of the present invention, there is provided a method for driving a plasma display panel, comprising: dividing the plurality of address electrodes into a plurality of address electrode groups; applying a scan pulse to each of the plurality of scan electrodes in accordance with a scan sequence during an address period of a plurality of sub-fields; applying a data pulse to each of the plurality of address electrode groups in association with a scan pulse, wherein an application time point for at least one of the plurality of address electrode groups is difference from that of the other address electrode groups during an address period of at least one of sub-field; wherein the width of the scan pulses applied to a predetermined number of the plurality of scan electrodes during an address period of at least one sub-field is greater than the width of the scan pulse applied to the remaining scan electrodes.

According to still another aspect of the present invention, there is provided a plasma display apparatus, comprising: a plurality of scan electrodes; a plurality of address electrodes, the plurality of address electrodes crossing the scan electrodes; a scan driver for driving the plurality of scan electrodes; a data driver for driving the plurality of address electrodes; and a controller configured to: apply a scan pulse, according to a scan sequence, to each of the plurality of scan electrodes during an address period of a plurality of sub-fields within a frame; and apply a data pulse to each of a plurality of data electrode groups in association with a scan pulse, wherein an application time point for at least one of the plurality of data electrode groups is different from that of the other data electrode groups during an address period of at least one sub-field of said plurality of sub-fields, where each of the plurality of data electrode groups includes one or more address electrodes; wherein the width of the scan pulses applied to a predetermined number of the plurality of scan electrodes during an address period of at least one sub-field is greater than the width of the scan pulse applied to the remaining scan electrodes.

It is to be understood that both the foregoing general description and the following detailed description are exemplary and explanatory and are intended to provide further explanation of the invention as claimed.

BRIEF DESCRIPTION OF THE DRAWINGS

The accompany drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to embodiments of the present invention, examples of which are illustrated in the accompanying drawings.

Figure 7:
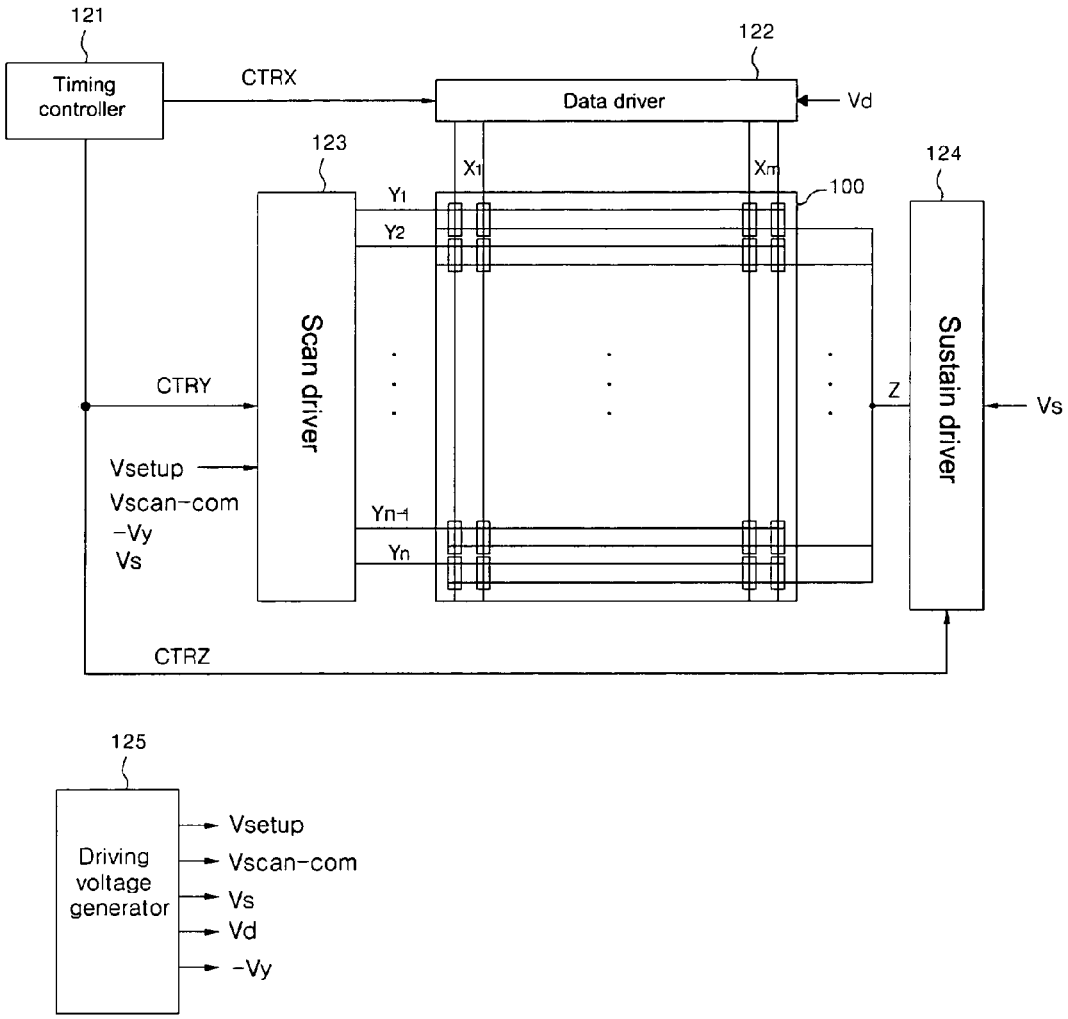
FIG. 7 illustrates a plasma display apparatus according to an embodiment of the invention.

FIG. 7 illustrates a plasma display apparatus according to embodiments of the invention. The plasma display apparatus includes a plasma display panel 100, a data driver 122 for supplying data to address electrodes $X_1$ to $X_m$, a scan driver 123 for driving scan electrodes $Y_1$ to $Y_n$, a sustain driver 124 for driving sustain electrodes Z which are common electrodes, a timing controller 121 for controlling the data driver 122, the scan driver 123, the sustain driver 124, and a driving voltage generator 125 for supplying the driving voltage required for each driver 122, 123, 124.

The plasma display panel 100 is formed of an upper substrate (not shown) and a lower substrate (not shown), which are combined with a predetermined gap in between. A plurality of electrodes, for example, scan electrodes $Y_1$ to $Y_n$ and sustain electrodes Z are formed in pairs in the upper substrate. Address electrodes $X_1$ to $X_m$, which cross the scan electrodes $Y_1$ to $Y_n$ and the sustain electrodes Z are formed in the lower substrate.

The data driver 122 receives data mapped for each sub-field by a sub-field mapping circuit after being inverse-gamma corrected and error-diffused through an inverse gamma correction circuit, an error diffusion circuit, or the like. The data driver 122 samples and latches the mapped data in response to a timing control signal CTRX from the timing controller 121, and then supplies the data to address electrodes $X_1$ to $X_m$.

The scan driver 123, under the control of the timing controller 121, supplies a ramp-up waveform and a ramp-down waveform to the scan electrodes $Y_1$ to $Y_n$, during a reset period. In addition, the scan driver 123, sequentially supplies a scan pulse of scan voltage (−Vy) to the scan electrodes Y1 to Yn during the address period, and supplies a sustain pulse (sus) to the scan electrodes $Y_1$ to $Y_n$ during the sustain period. Accordingly, the timing controller controls the application time points of the data pulses applied to address electrodes $X_1$ to $X_m$ and the scan pulses applied to the scan electrodes $Y_1$ to $Y_n$.

The sustain driver 124, under the control of the timing controller 121, supplies a bias voltage (Vs) to the sustain electrodes Z during the set-down period and the address period. During the sustain period, the sustain driver 124 operates alternately with the scan driver 123 to supply a sustain pulse to the sustain electrodes Z. Furthermore, width of the sustain pulse supplied by the sustain driver 124 is controlled such that the width of the sustain pulse applied first during the sustain period is larger than that of other sustain pulse. In other words, the first sustain pulse supplied after the address period has a width greater than the width of another sustain pulse applied during the sustain period.

The timing controller 121 receives a vertical/horizontal synchronizing signal and a clock signal (not shown) and generates control signals CTRX, CTRY, and CTRZ for controlling the operation timing and synchronization of each driver 122, 123, 124. In particular, the data driver 122 and the scan driver 123 are controlled such that the address electrodes during at least one sub-filed of a frame are divided into a plurality of address electrode groups, and the application time point of the data pulses applied to at least one of the address electrode groups during the address period is different from that of a scan pulse applied to the scan electrode.

The data control signal CTRX includes a sampling clock for sampling data, a latch control signal, and a switch control signal for controlling the on/off time of an energy recovery circuit and a driving switch element. The scan control signal CTRY includes a switch control signal for controlling the on/off time of the energy recovery circuit and the driving switch element within the scan driver 123. The sustain control signal CTRZ includes a switch control signal for controlling on/off time of the energy recovery circuit and the driving switch element inside the sustain driver 124.

The driving voltage generator 125 generates the voltages necessary to driver the display panel, for example, a set-up voltage Vsetup, a scan common voltage Vscan-com, a scan voltage −Vy, a sustain voltage Vs, a data voltage Vd, and the like. These driving voltages may vary with the composition of the discharge gas or the structure of the discharge cells.

When the scan driving unit 123 sequentially applies a scan pulse of the scan voltage −Vy to the scan electrodes Y1 to Yn during the address period of at least one sub-field, the width of the scan pulse applied to one or more of the plurality of the scan electrodes $Y_1$ to Ym is wider than the scan pulse applied to at least one other scan electrode. Preferably, the width of the scan pulse applied to a predetermined number of the scan electrodes $Y_1$ to Ya (where, a is a positive integer less than m), is wider than the scan pulse applied to the remaining m−a scan electrodes. In addition, the scan driving unit 123 may control the width of the scan pulses applied to the scan electrodes $Y_1$ to Ym during an address period of at least one sub-field of the frame such that it becomes narrower from the first scan electrode $Y_1$ to the last scan electrode Ym.

The waveforms of FIGS. 8*a* to 8*e* illustrate that the application time points of the data pulses applied to the address electrodes during the address period of at least one sub-field are different from the application time point of a scan pulse applied during the address period. The difference between the application time point of the data pulses and the scan pulse may be set in various ways as illustrated in FIGS. 8*a*-8*e*.

Figure 8A:
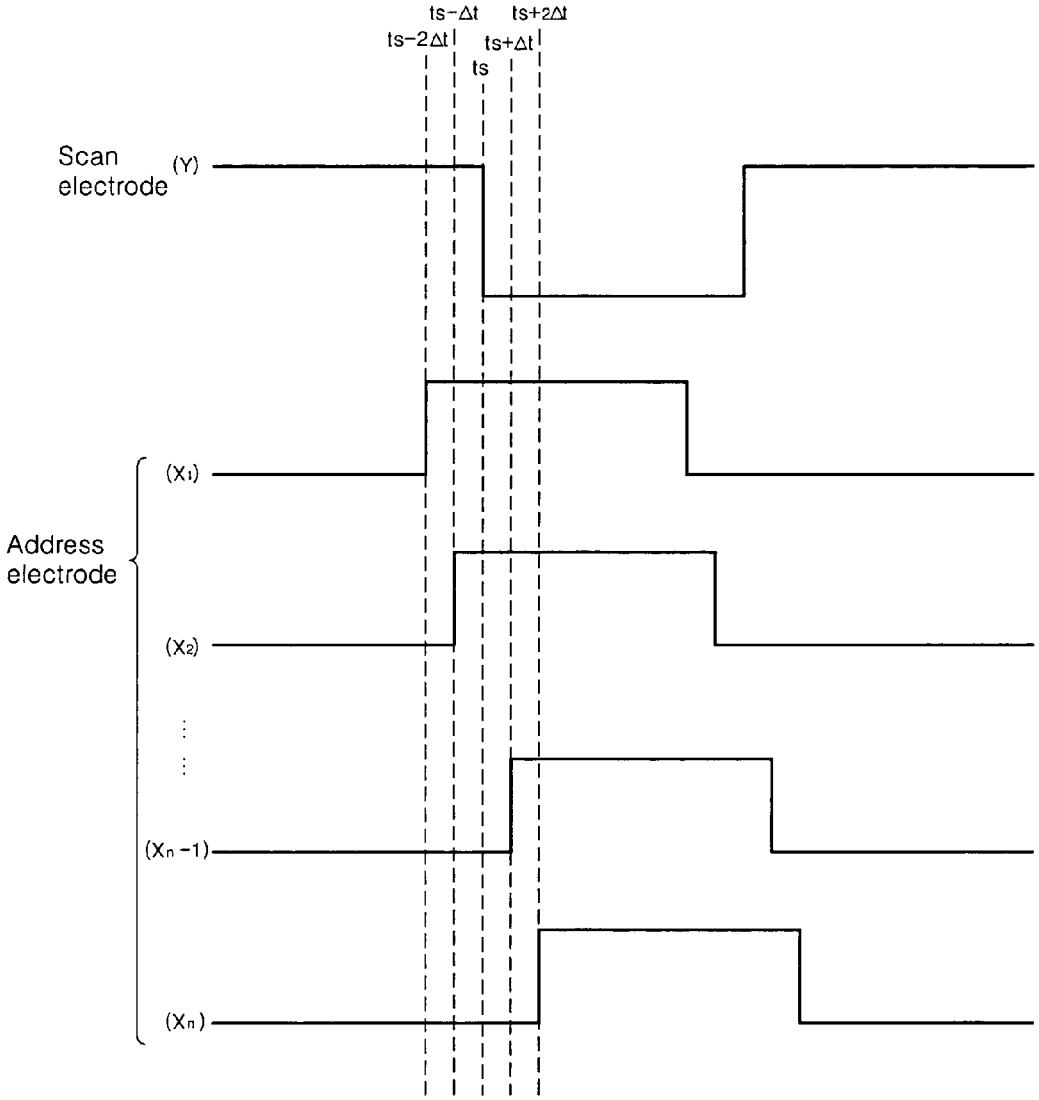
FIGS. 8*a* to 8*e* illustrate driving waveforms according to the present invention.

For example, as illustrated in FIG. 8*a*, assuming the scan pulse is applied to the scan electrode Y at a time point ts, a data pulse is applied to each of the address electrodes, according to the arranged order of the address electrodes $X_1$ to $X_n$, at a time point which is prior to or later than the application time point of the scan pulse by some predetermined factor Δt. In the case of address electrode $X_1$, a data pulse is applied at a time point which is 2Δt ahead of the scan pulse, i.e., at a time point ts−2Δt. In the case of address electrode $X_2$, a data pulse is applied at a time point, which is Δt ahead of that of the scan pulse applied to the scan electrode Y, i.e., at a time point ts−Δt. In this way, a data pulse is applied to the address electrode $X_{(n-1)}$ at a time point ts+Δt, and to the address electrode $X_n$ at a time point ts+2Δt.

Figure 8B:
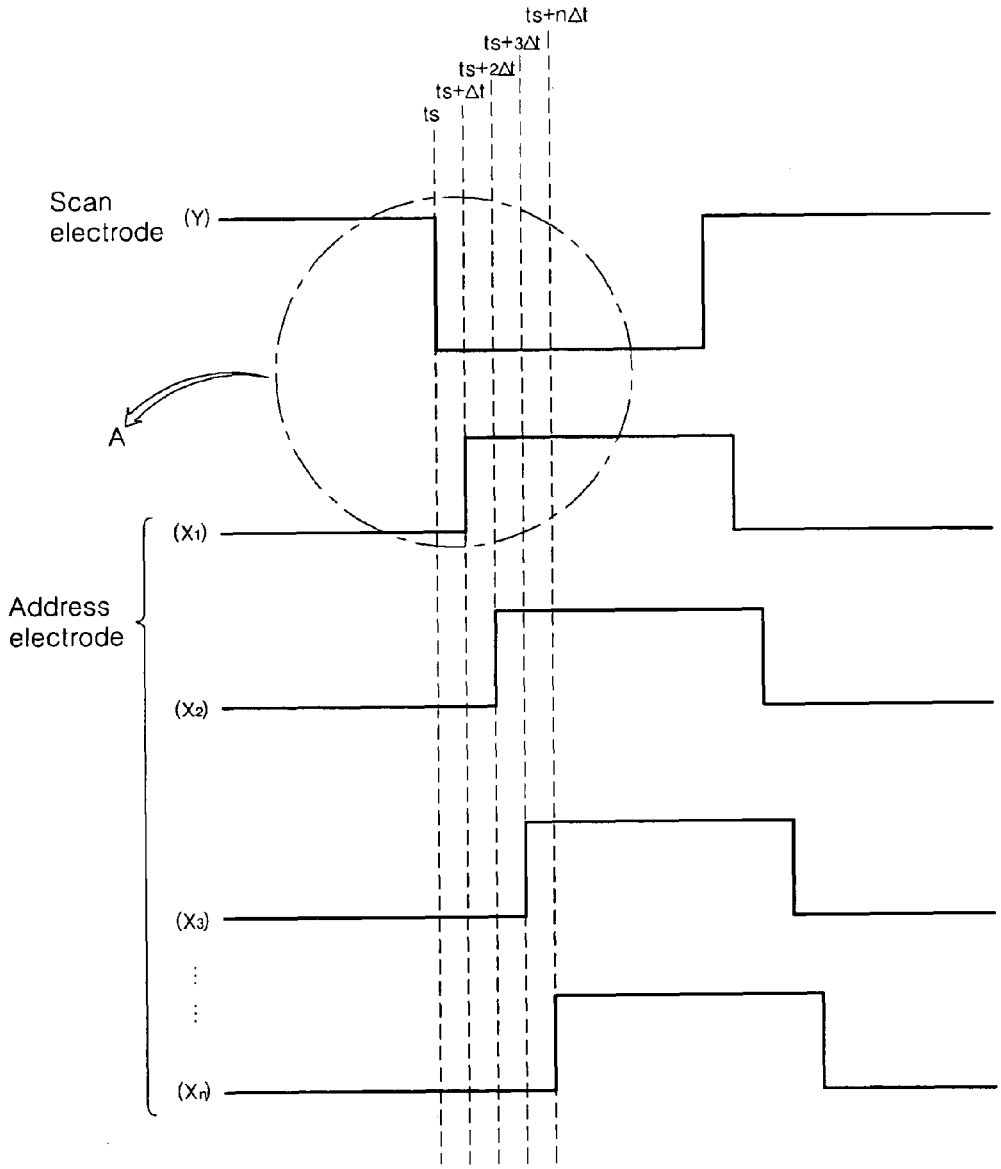

Alternatively, as illustrated in FIG. 8*b*, the application time points of all the data pulses may be after the application time point of the scan pulse. For example, a data pulse is applied to the address electrode $X_1$ at a time point, which is Δt after the scan pulse applied to the scan electrode Y, i.e., at the time point ts+Δt. In the case of the address electrode $X_2$, a data pulse is applied at a time point, which is 2Δt after that of the scan pulse applied to the scan electrode Y, and so on such that a data pulse is applied to the address electrode Xn at a time point, which is nΔt after that of the scan pulse.

Figure 8C:
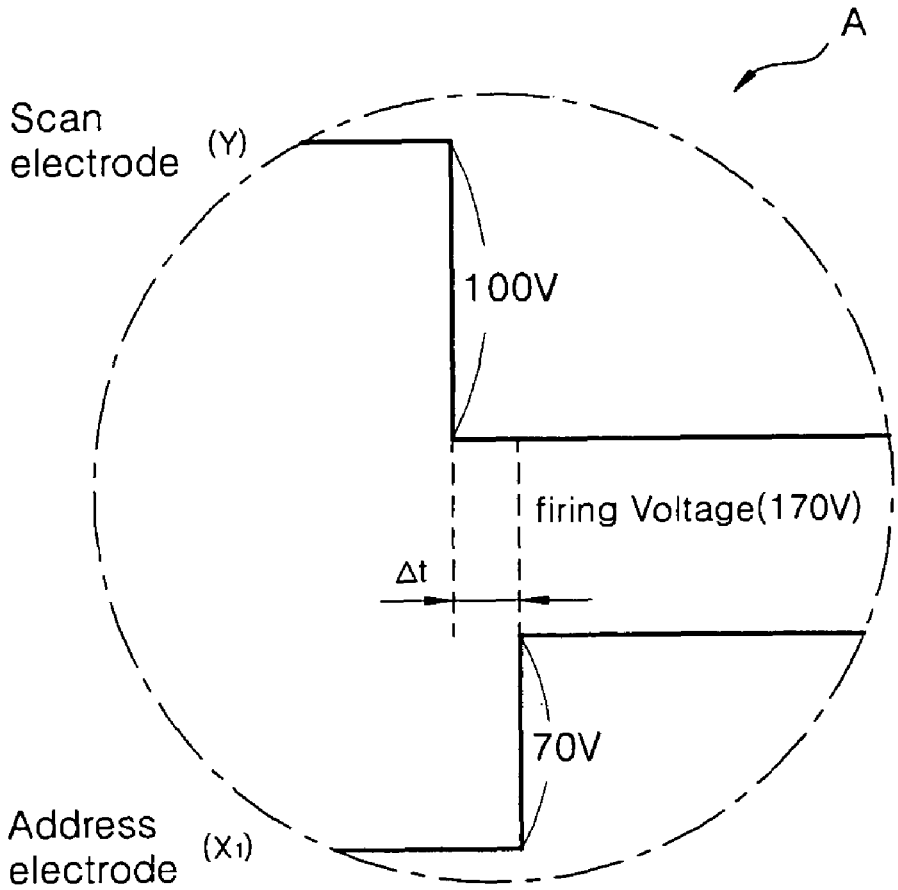

FIG. 8*c* illustrates a detailed diagram of region A of FIG. 8*b*, assuming that the firing voltage of an address discharge is 170V, the scan pulse voltage is 100V, and the data pulse voltage 70V. As illustrated, first, due to the scan pulse applied to the scan electrode Y, the voltage difference between the scan electrode Y and the address electrode $X_1$ is 100V. Then, some time, Δt, after the scan pulse application, a data pulse is applied to the address electrode X1, increasing the voltage difference between the scan electrode Y and the address electrode X1 to 170V. Accordingly, the voltage difference between the scan electrode Y and the address electrode $X_1$ becomes a discharge firing voltage and thus an address discharge is generated between the scan electrode Y and the address electrode $X_1$.

Furthermore, the time points of the data pulses applied to the address electrodes $X_1$ to $X_n$ may be established to precede that of the scan pulse applied to the scan electrode Y by a predetermined factor Δt. This driving waveform is illustrated in FIG. 8*d*.

Figure 8D:
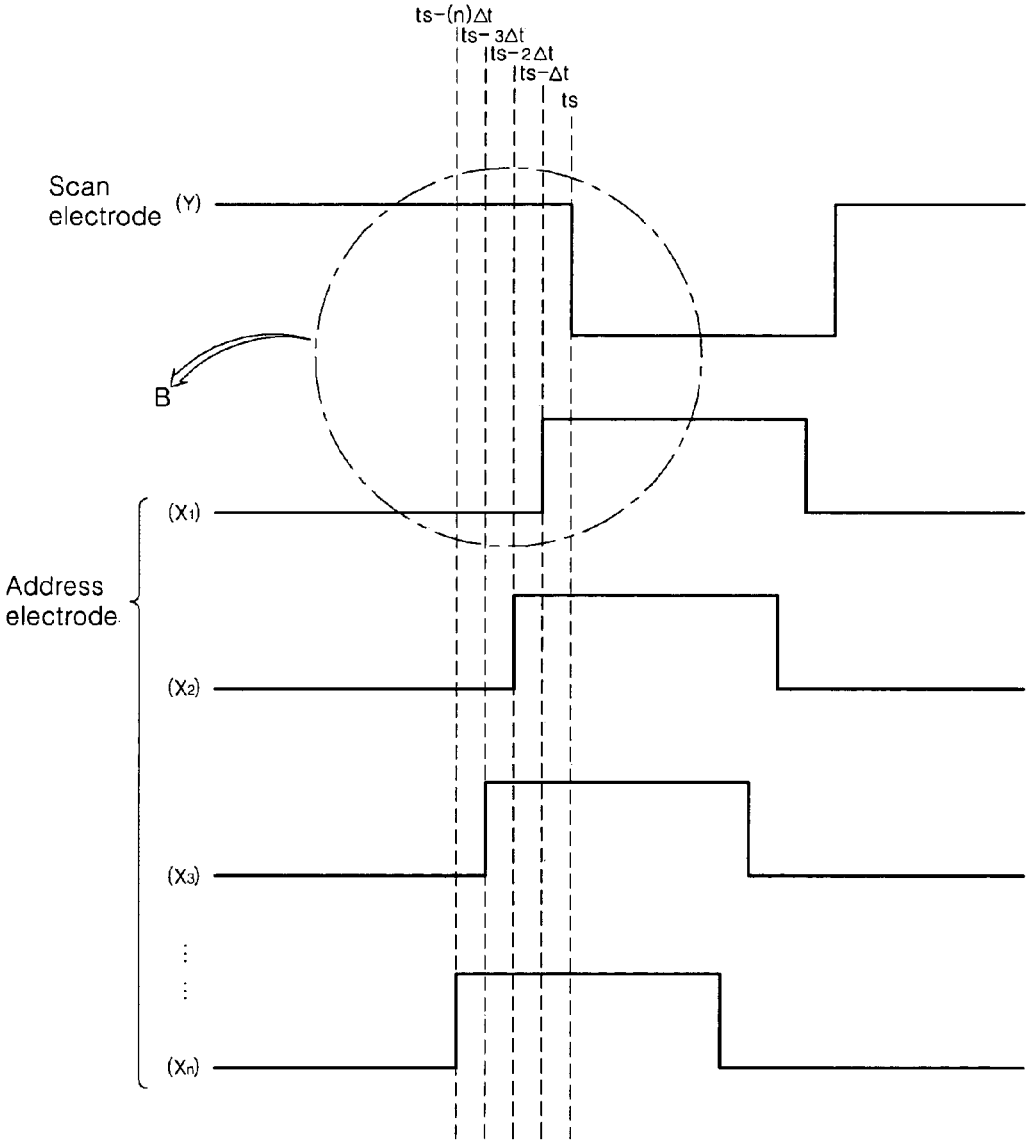
Figure 8E:
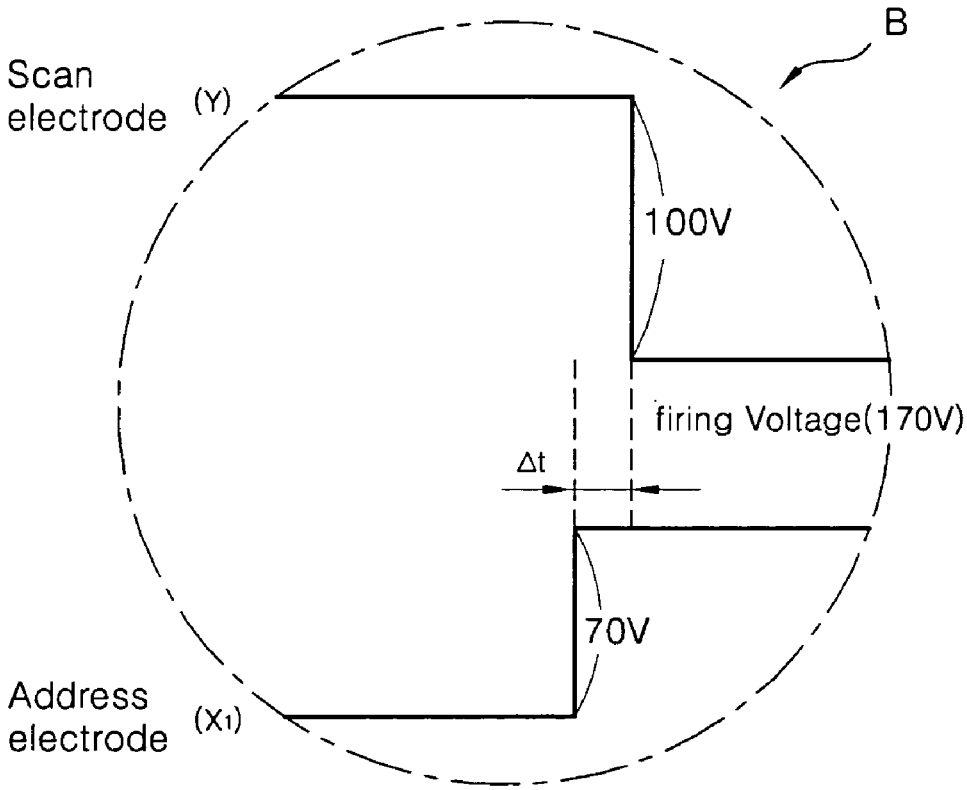

For example, as illustrated in FIG. 8*d*, assuming the scan pulse is applied to the scan electrode Y at a time point ts, a data pulse is applied to each of the address electrodes, according to the arranged order of the address electrodes $X_1$ to $X_n$, at a time point which is prior to the application time point of the scan pulse by the predetermined factor Δt.

Figure 9A:
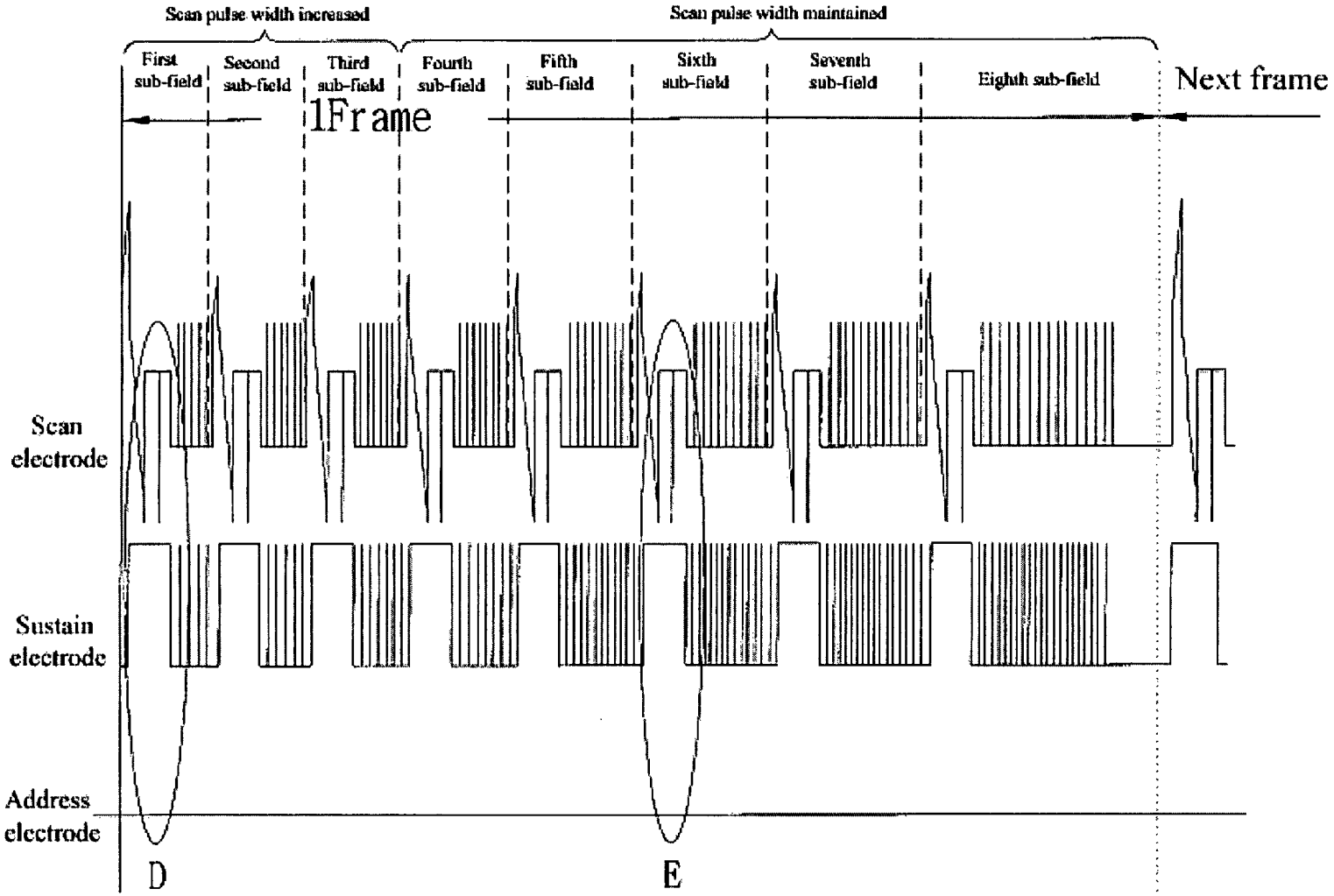
FIGS. 9*a* to 9*e* illustrate the width of a scan pulse on a sub-field basis according to the present invention.
Figure 9B:
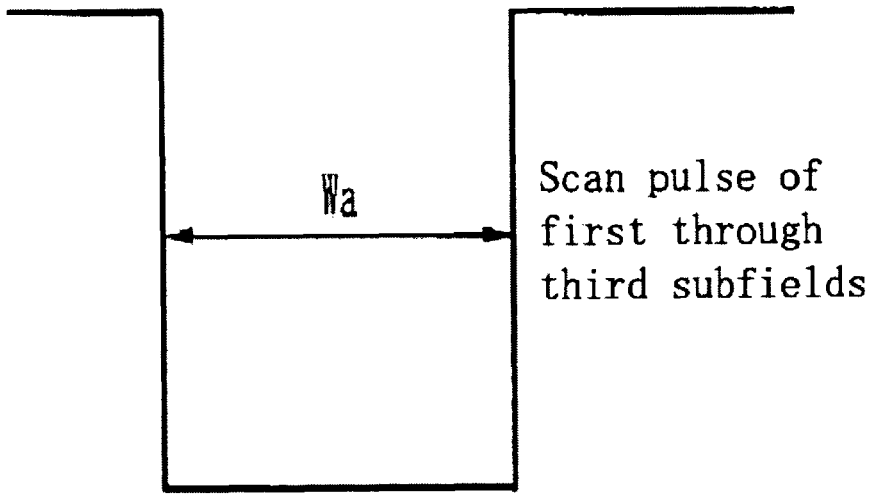
Figure 9C:
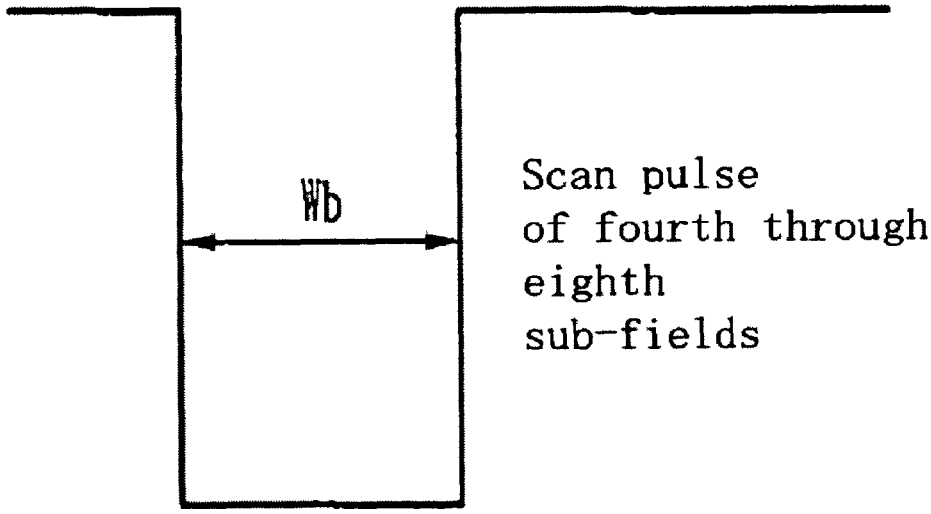
Figure 9D:
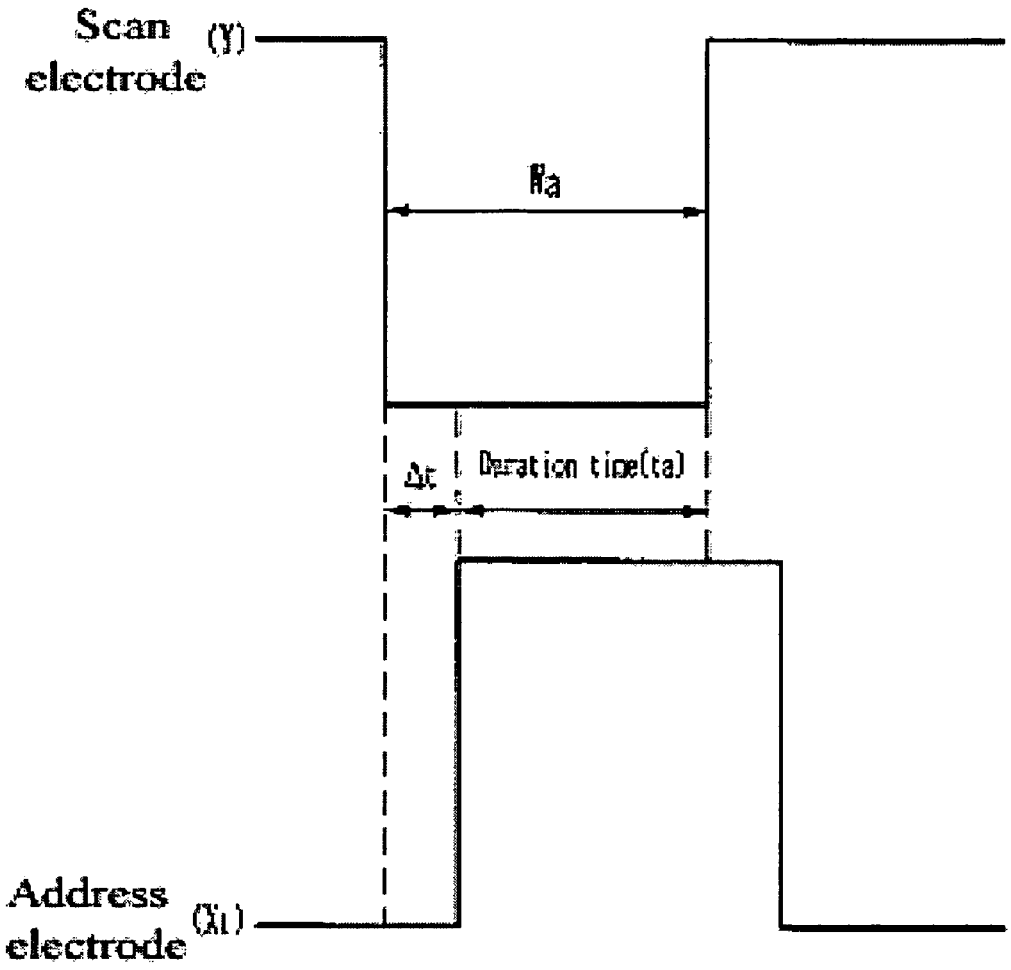
Figure 9E:
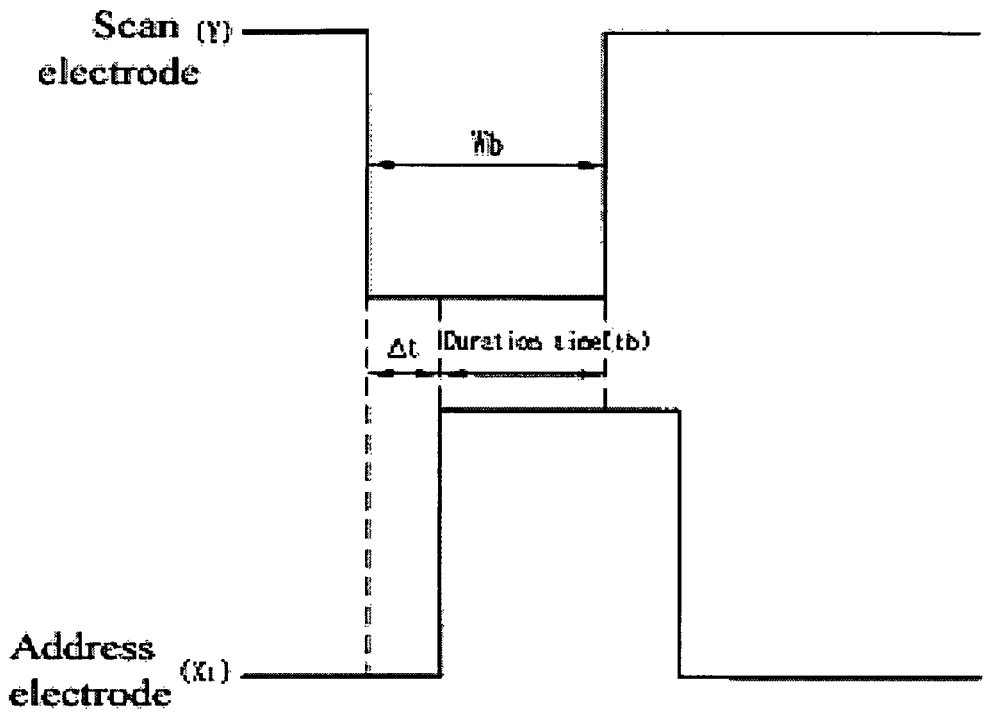

FIG. 9*e* illustrates a detailed diagram of region B of FIG. 9*d*, assuming that the firing voltage of an address discharge is 170V, the scan pulse voltage is 100V, and the data pulse voltage 70V. In the region B, first, due to the data pulse applied to the address electrode $X_1$, the voltage difference between the scan electrode Y and the address electrode $X_1$ is 70V. Then, after Δt of the data pulse application, due to a scan pulse applied to the scan electrode Y, the voltage difference between the scan electrode Y and the address electrodes $X_1$ to $X_n$ increases to about 170V. Accordingly, the voltage difference between the scan electrode Y and the address electrode $X_1$ becomes a discharge firing voltage and thus an address discharge is generated between the scan electrode Y and the address electrode $X_1$.

As described above, in conjunction with FIGS. 8*a* to 8*e*, the time difference between the application time points of the scan pulse and the data pulses applied to the scan electrode Y and the address electrodes $X_1$ to $X_n$, respectively, has been explained while introducing a concept of Δt. Also, the difference in the time points of the data pulses applied to the address electrodes $X_1$ to $X_n$ has been explained in a similar manner. Here, for example, when the time point of a scan pulse applied to the scan electrode Y is ts, a time difference with a data pulse nearest to the time point ts of the scan pulse is Δt, and a time difference with a data pulse second-nearest to the time point ts of the scan pulse is twice of Δt, i.e., 2Δt. The Δt value remains constant. That is, while the time points of the scan pulse and the data pulse applied respectively to the scan electrode Y and the address electrodes $X_1$ to $X_n$ are made different, the time difference between the time points of data pulses applied to each of the address electrodes $X_1$ to $X_n$ remains the same.

Although the difference in the time points of the data pulses applied to the address electrodes $X_1$ to $X_n$ is constant, the difference between the application time point of a scan pulse and the application time point of the data pulse applied nearest in time to the scan pulse may be constant or vary. For example, the time difference between the application time point ts of the scan pulse applied to a first scan electrode $Y_1$ and that of the data pulse nearest thereto can be Δt, and the time different between the scan pulse applied to a second scan electrode $Y_2$ and that of the date pulse nearest thereto may be 2Δt during the same address period Alternatively, the difference between the time point of a scan pulse and the data pulse applied closest thereto could be different for different sub-fields. Preferably the difference between the application time point of a scan pulse ts and that of a data pulse nearest thereto is in the range of 10 ns to 1000 ns, considering the limited time of an address period. Furthermore, considering the width of a scan pulse, the value of Δt is preferably in the range of 1 percent to 100 percent of the width of a predetermined scan pulse. For example, if the width of the scan pulses is 1 μs, the time difference Δt is preferably in the range of 10 ns to 100 ns.

The difference between the application time point of the data pulses applied to adjacent address electrodes may vary. For example, if the time point of a scan pulse applied to the scan electrode Y is 0 ns, and a data pulse is applied to a first address electrode $X_1$ at a time point of 10 ns, the difference in the time points of the scan pulse and the data pulse is 10 ns. Then a data pulse is applied to the next address electrode $X_2$ at a time point of 20 ns, resulting in a difference between the time points of the scan pulse and the data pulse applied to the address electrode $X_2$ of 20 ns. However, the difference between the time points of the data pulses applied to the address electrodes $X_1$ and $X_2$ is 10 ns. Furthermore, to the next address electrode $X_3$, a data pulse is applied at a time point of 40 ns, and thus the difference in the time points of the scan pulse and the data pulse applied respectively to the scan electrode Y and the address electrode $X_3$ becomes 40 ns. Therefore, the time points of the data pulses applied to the address electrodes $X_2$ and $X_3$ respectively have a difference of 20 ns.

Figure 10A:
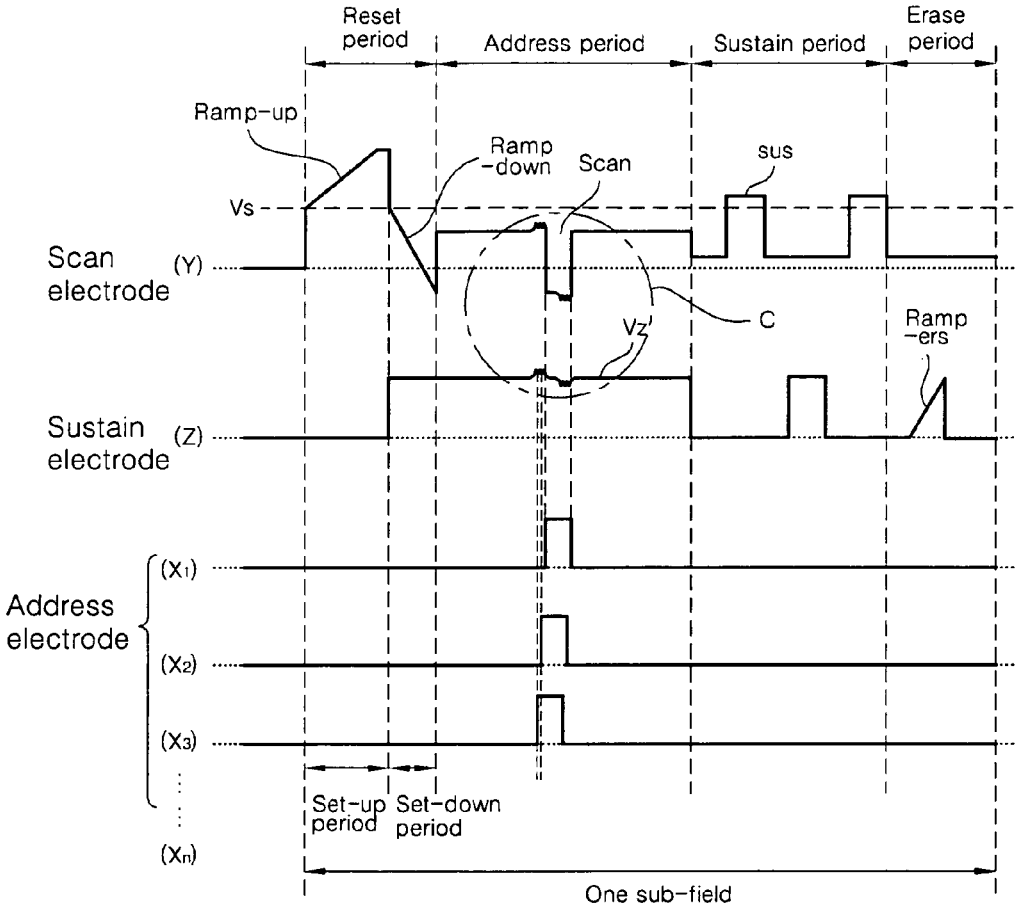
FIGS. 10*a* and 10*b* illustrate the noise reduction achieved by the present invention.
Figure 10B:
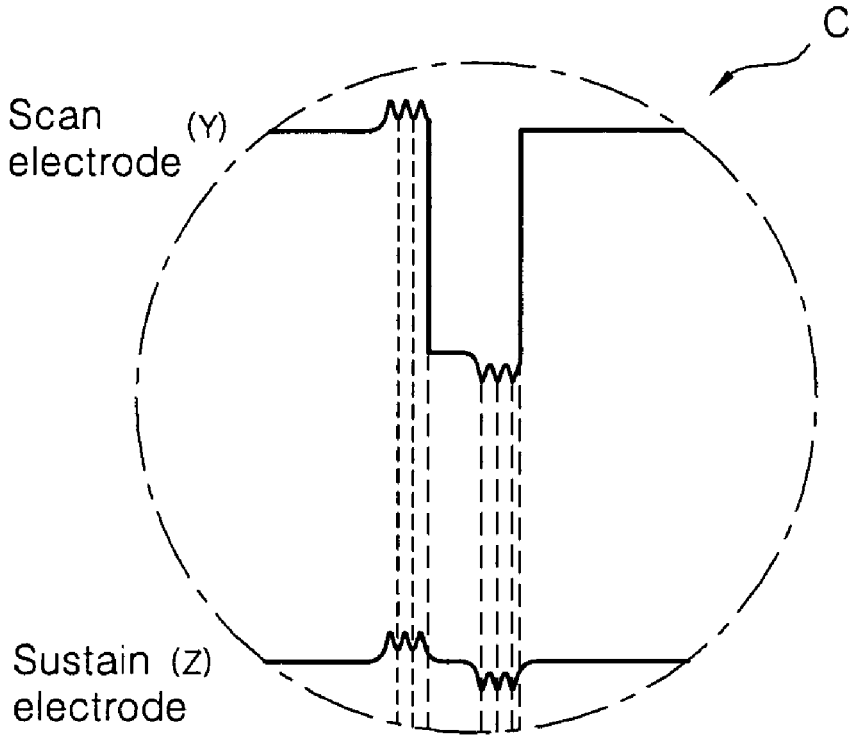

As described above, if the time point of a scan pulse applied to the scan electrode Y is different from that of a data pulse applied to the address electrodes $X_1$ to $X_n$, the noise in the waveforms applied to the scan electrode and the sustain electrode is reduced due to the reduction in the coupling through the capacitance of the panel at each time point of the data pulses applied to the address electrodes $X_1$ to $X_n$. This reduced noise is illustrated in FIGS. 10*a* and 10*b*.

Figure 1:
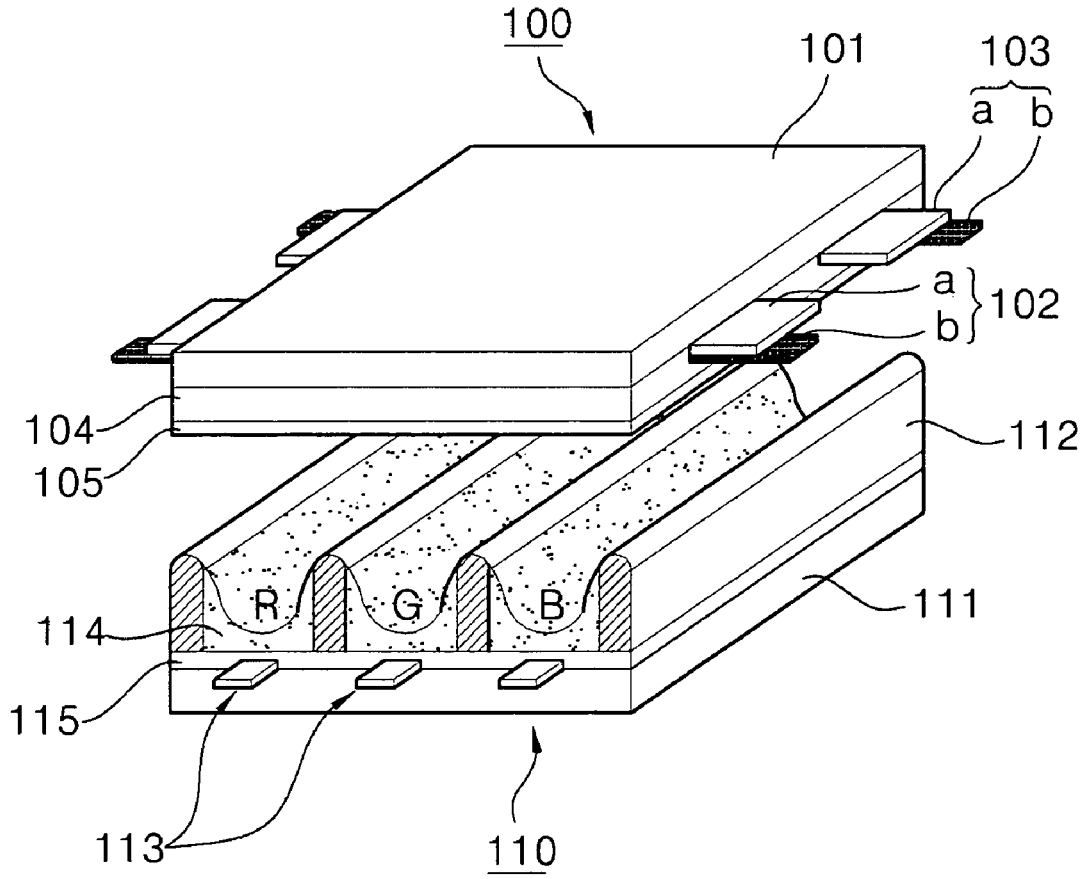
Fig. 1 Related Art
FIG. 1 is a perspective view illustrating the configuration of a conventional plasma display panel.
Figure 2:
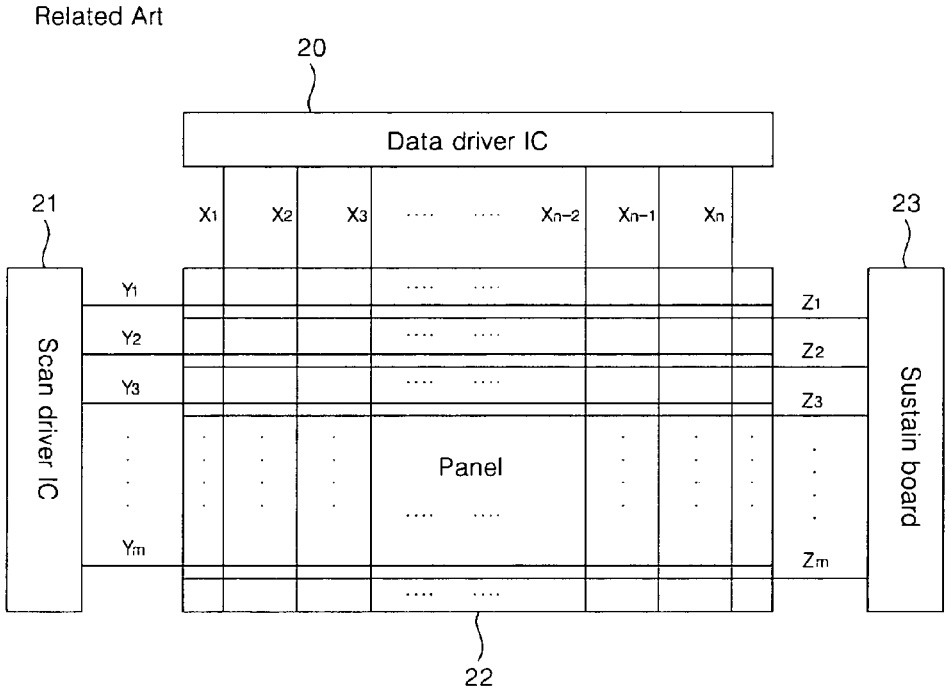
FIG. 2 is a view illustrating the interconnection between a plasma display panel and a driving module.
Figure 3:
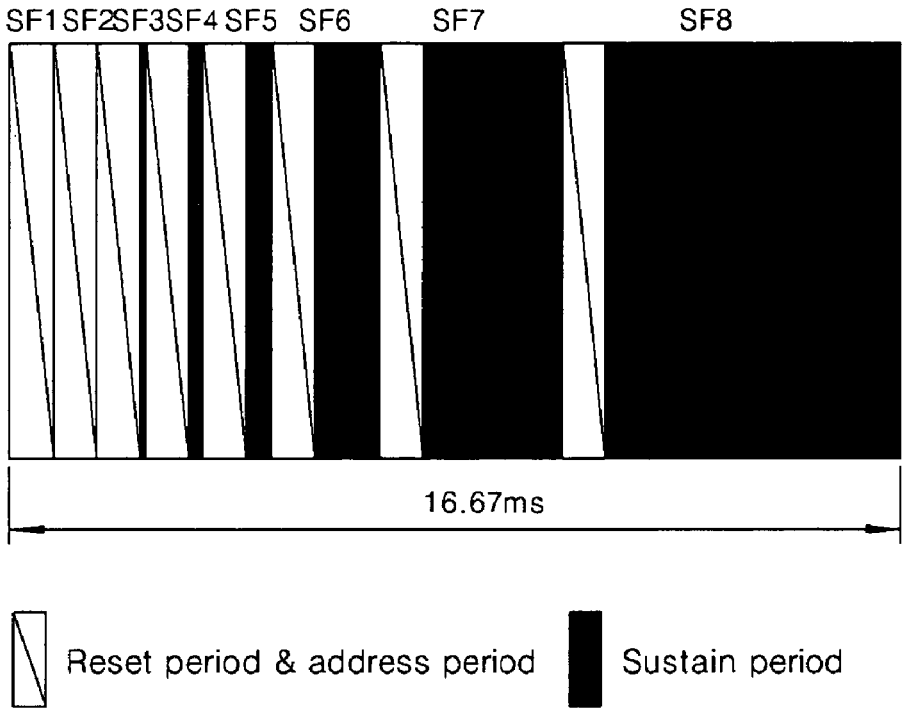
Fig. 3 Related Art
FIG. 3 illustrates a method of implementing grey scale in a conventional plasma display panel.
Figure 4:
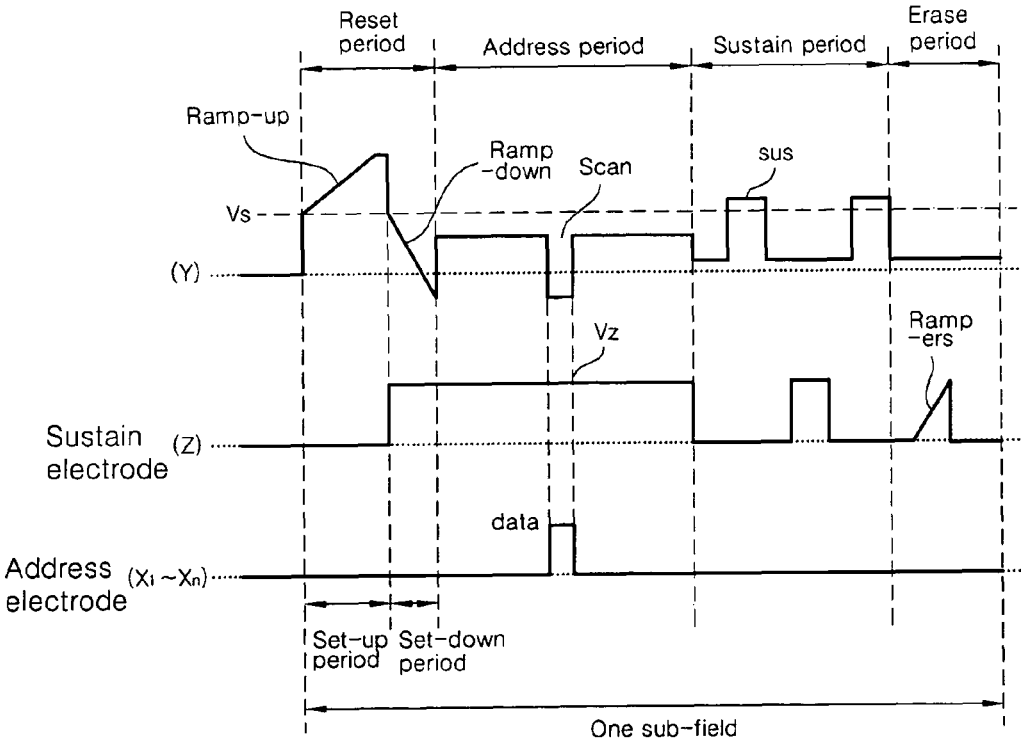
Fig. 4 Related Art
FIG. 4 illustrates a driving waveform according to a conventional method of driving a plasma display panel.
Figure 5:
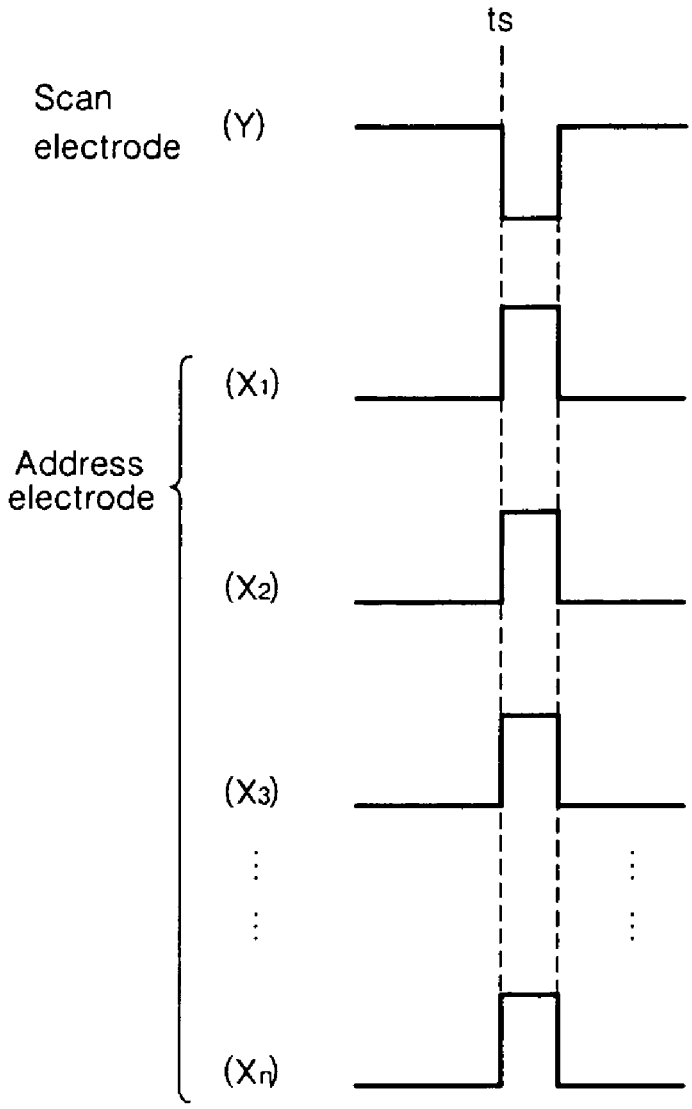
Fig. 5 Related Art
FIG. 5 illustrates application time points of pulses being applied during an address period in a conventional method of driving a plasma display panel.

Furthermore, although not shown in FIGS. 8*a* to 8*e*, the width of the scan pulses applied to the scan electrodes during the address period of a predetermined number of sub-fields of a frame is wider than that of scan pulses applied to the scan electrodes during the address period of the remaining sub-fields in the frame. The predetermined number of sub-fields selected in which the wider scan pulse is applied varies depending upon the discharge properties of the plasma display panel. For example, the predetermined number of sub-fields may include only the sub-field having the lowest weight, or a number of the sub-fields in order of the magnitude of their weights. This is because the address jitter characteristic can be relatively profound in those sub-fields where the length of the sustain period is relatively short. Preferably, those sub-fields in which the width of a scan pulse applied to the scan electrodes is relatively wide are from the sub-field having the lowest weight to the sub-field having the third lowest weight, for example, the first sub-field, the second sub-field and the third sub-field where the frame is divided as shown in FIG. 3.

FIG. 9*a* illustrates exemplary waveforms applied during multiple sub-fields of a single frame. As illustrated in FIG. 9*a*, the width of the scan pulses applied to the scan electrodes during the address periods of the first, second and third sub-fields is set to be wider than that of the scan pulses applied to the scan electrodes during the address periods of the remaining sub-fields, i.e., the fourth, fifth, sixth, seventh, and eighth sub-fields. The width of the scan pulse applied to the scan electrodes during the address period of the first sub-field, marked as region D in FIG. 9*a*, is Wa, illustrated in FIG. 9*b*, which is wider than the width Wb, illustrated in FIG. 9*c*, of the scan pulses applied to the scan electrodes during the sixth sub-field of the frame, noted as region E in FIG. 9*a*. The width Wa is preferably set to be one to three times the width Wb of the scan pulses applied during the address period of the remaining sub-fields, in order to prevent degradation of the jitter characteristic of address discharging while securing a sufficient duration time between the scan pulse and the data pulse.

FIG. 9*d* illustrates the address discharge duration time during the first through the third sub-fields. Assuming that the time difference between the application time point of the scan pulse and the application time point of the data pulse is $\Delta t$, as illustrated in FIG. 9*d*, the duration time of the address discharge (i.e., the time in which the scan pulse and address pulse overlap each other) is the width of the scan pulse Wa minus the difference between the application time points of the data pulse and scan pulse, i.e., $Wa-\Delta t$. Likewise, the duration time of the address discharge in the remaining sub-fields (i.e., those sub-fields where the scan pulse width is Wb) is $Wb-\Delta t$, as illustrated in FIG. 9*e*. The relation of $0<(ta-tb)$ is established between ta and tb. As a result, since sufficient duration time is secured in the initial sub-fields where a scan pulse having a relatively wide pulse width Wa is applied, degradation of address jitter can be prevented.

Figure 6:
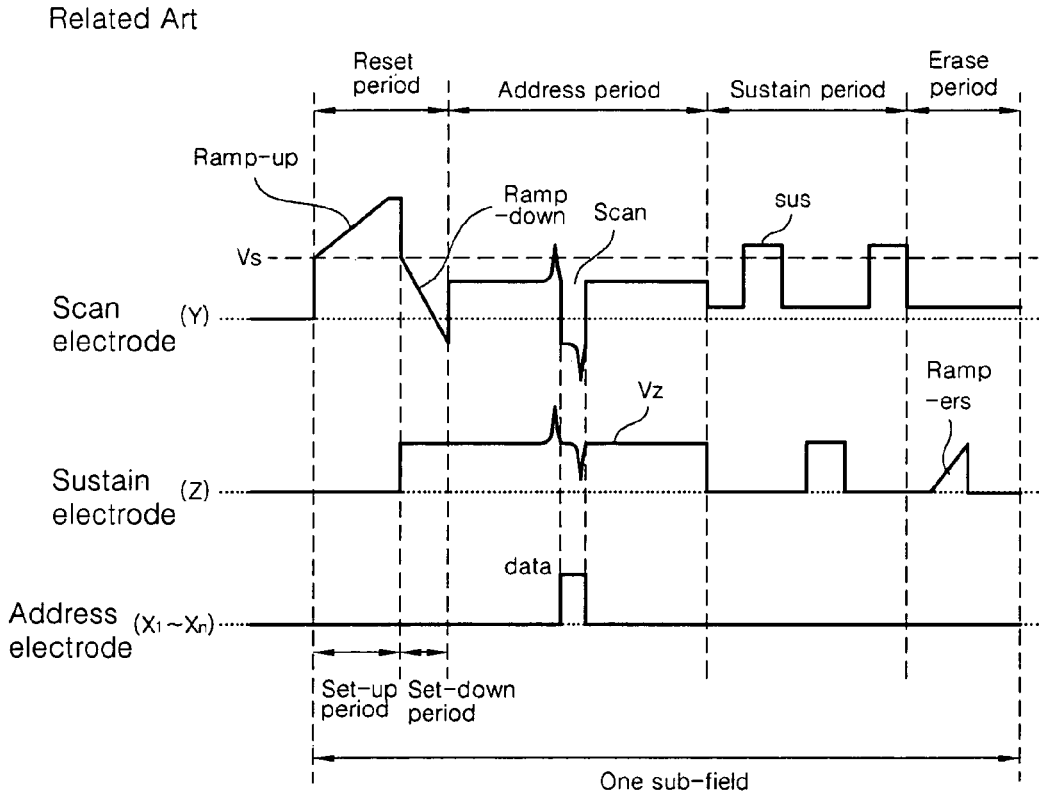
FIG. 6 is a diagram illustrating the noise generated in a conventional method of driving a plasma display panel.

Referring to FIG. 10*a*, it can be seen that the noise in the waveforms applied to the scan electrode and the sustain electrode is considerably reduced when compared to the noise in conventional driving methods as shown in FIG. 6. The reduced noise is illustrated in greater detail in FIG. 10*b*. The driving method of the present invention achieves this reduced noise because a data pulse is not applied to all the address electrodes $X_1$ to $X_n$ at the same time point as a scan pulse is applied to the scan electrode Y. At the point in time when the data pulse is abruptly raised, the rising noise occurring in the waveforms applied to the scan electrode and the sustain electrode is alleviated. Likewise, at the point in time when the data pulse falls rapidly, the falling noise occurring in the waveforms applied to the scan electrode and the sustain electrode is reduced.

In an initial sub-field where the sustain period is relatively short, the pulse width of the scan pulse is set to be wider than that of the scan pulses applied during another sub-field. Thus, degradation in an address jitter characteristic is prevented. As a result, by stabilizing address discharging of a plasma display panel, a single scan mode in which the entire panel is scanned by a single driving unit is made possible.

Figure 11:
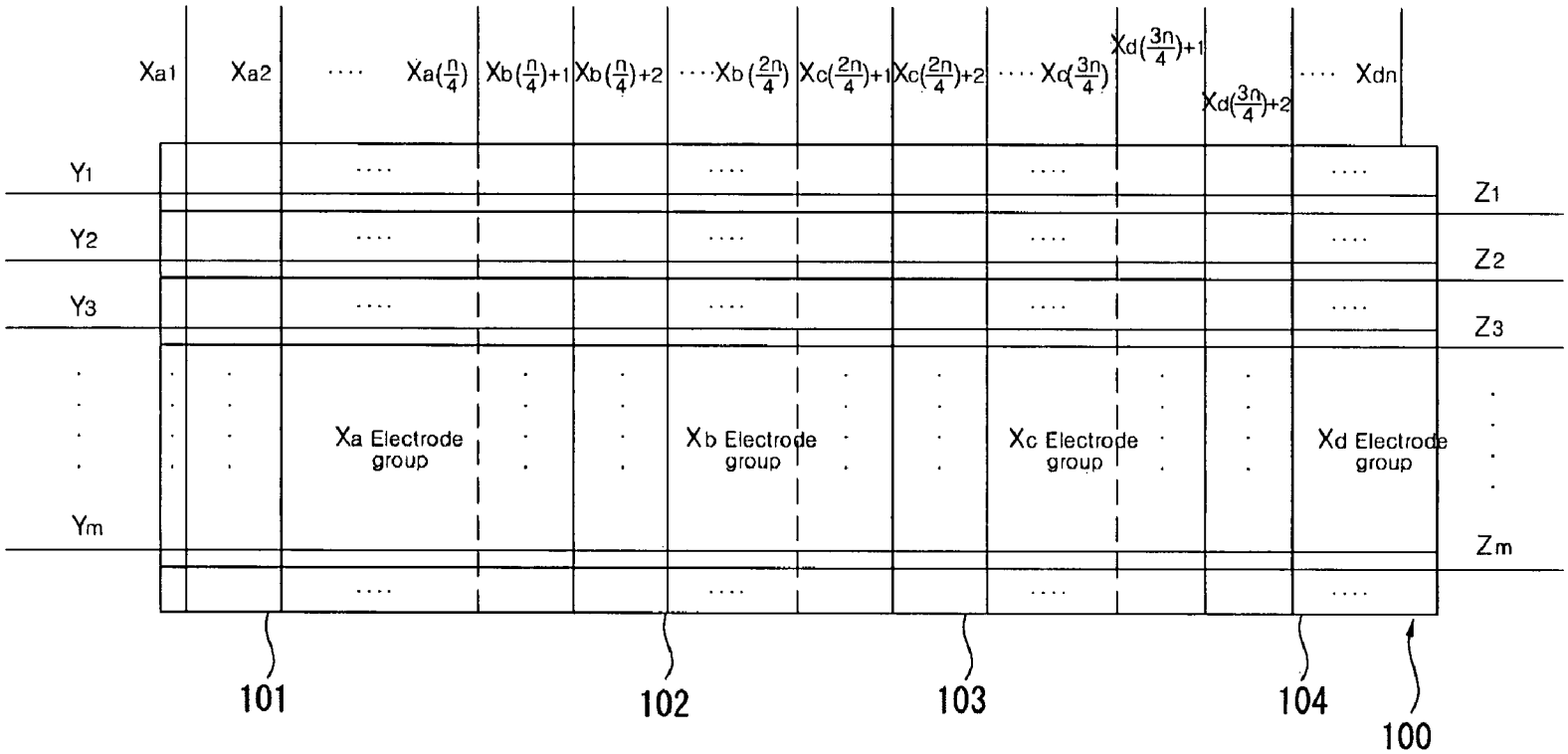
FIG. 11 illustrates grouping of address electrodes $X_1$ to $X_n$ according to an embodiment of the present invention.

FIG. 11 illustrates a plasma display apparatus according to another embodiment of the invention, where the address electrodes $X_1$ to $X_n$ are divided into a plurality of address electrodes groups. As illustrated in FIG. 11, the address electrodes $X_1$ to $X_n$ are divided into, for example, four address electrode groups. Address electrode group Xa includes address electrodes $Xa_1$ to $Xa_{n/4}$ (101), address electrode group Xb includes electrodes $Xb_{(1+n/4)}$ to $Xb_{2n/4}$ (102), address electrode group Xc includes electrodes $Xc_{(1+2n/4)}$ to $Xc_{3n/4}$ (103), and address electrode group Xd includes electrodes $X_{(1+3n/4)}$ to $Xd_n$ (104). A data pulse is applied to the address electrodes belonging to at least one of the above electrode groups at a time point different from that of a scan pulse applied to the scan electrode Y. That is, while the application time point of a data pulse applied to all the electrodes ($Xa_1$ to $Xa_{n/4}$) belonging to the Xa electrode group is different from that of a scan pulse to the scan electrode Y, they are all the same within the Xa electrode group. In addition, while the data pulses applied to the electrodes belonging to the remaining electrode groups 102, 103, and 104 can be applied at time points that are either the same or different from the time point of the scan pulse, all the time points are different from the application time point of a data pulse of the electrodes belonging to the first electrode group 101.

Although the number of electrodes belonged to each electrode group 101 to 104 illustrated in FIG. 11 is the same, each group may include a different number of electrodes, and/or the number of electrode groups may vary. Preferably, the number of electrode groups N is more than two and less than the total number of address electrodes, i.e., in a range of $2 \leqq N \leqq (n-1)$.

Figure 12A:
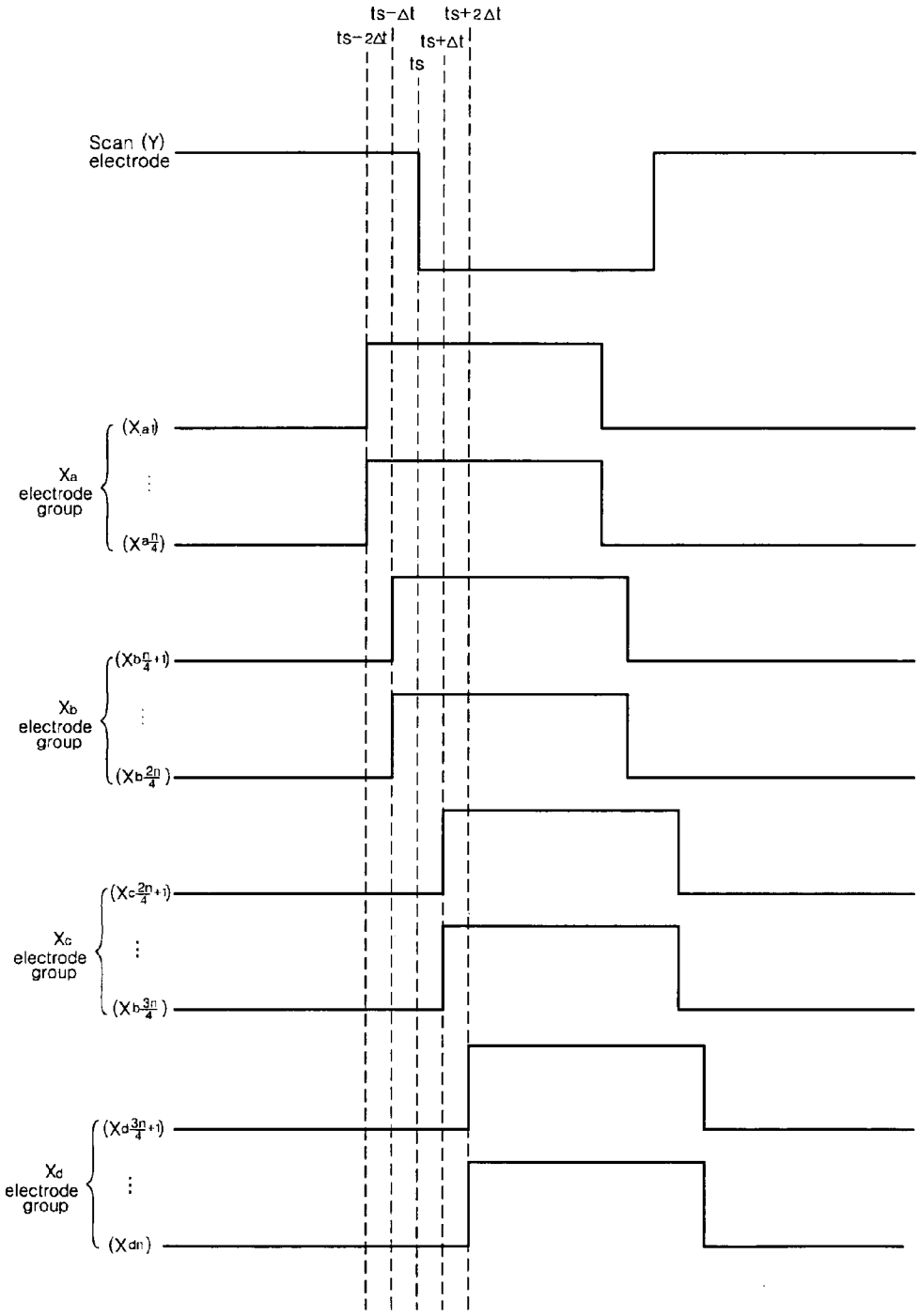
FIGS. 12*a* to 12*c* illustrate driving waveforms according to the another embodiment of the present invention.
Figure 12B:
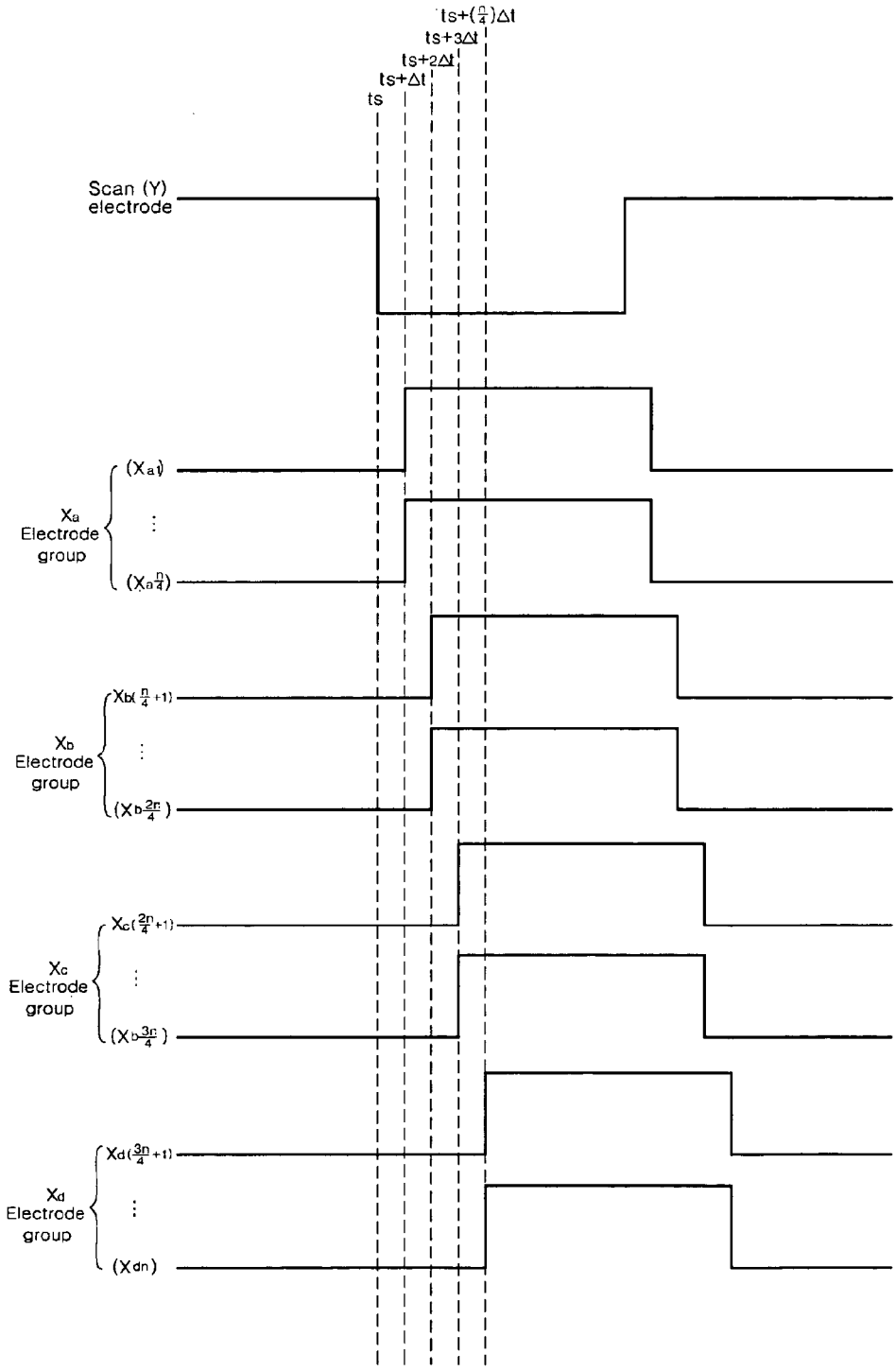
Figure 12C:
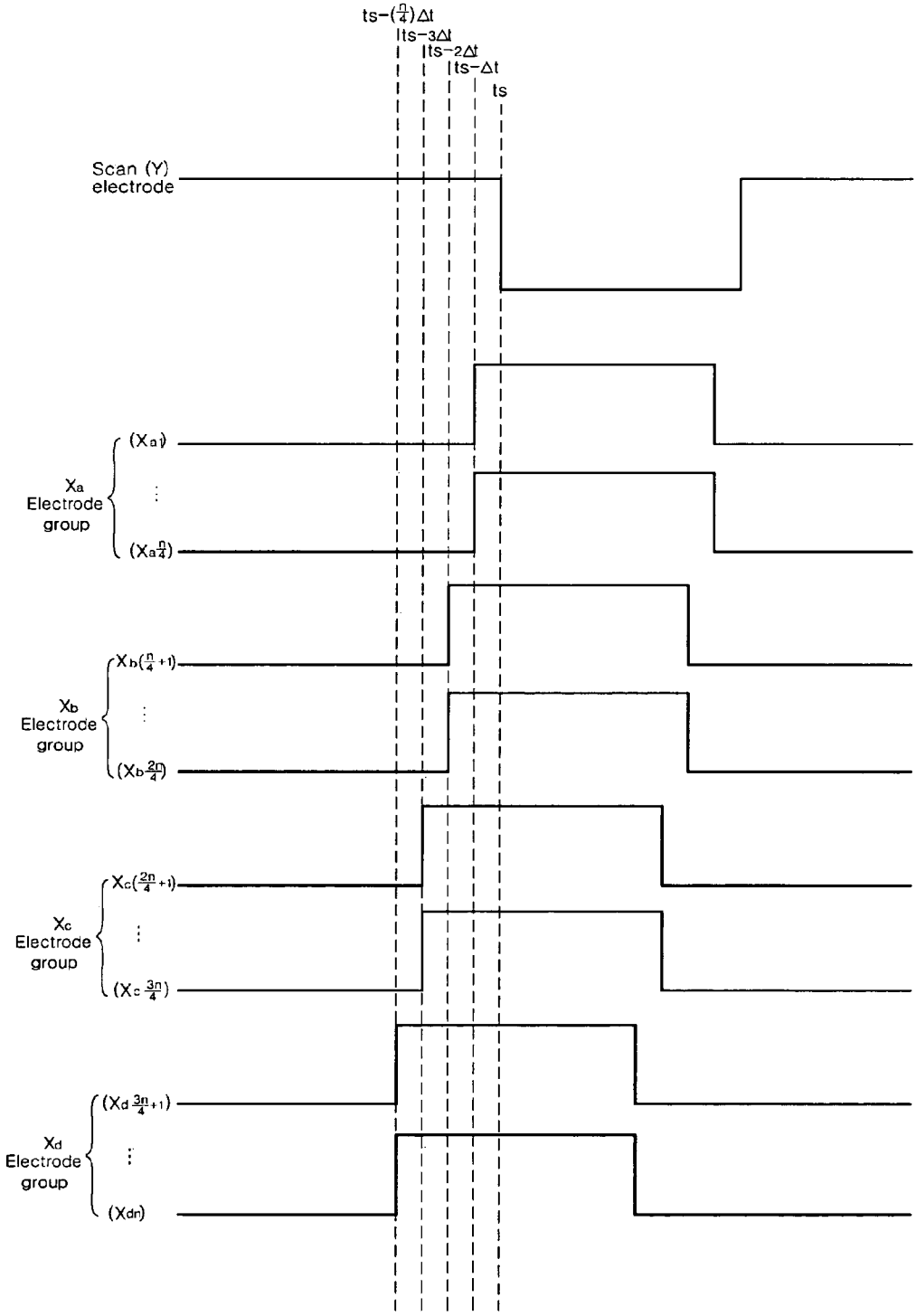

FIGS. 12*a* to 12*c* illustrate examples of applying a date pulse to the address electrodes in a driving waveform of a plasma display panel according the second embodiment of the invention. As illustrated in FIGS. 12*a* to 12*c*, the address electrodes $X_1$ to $X_n$ are divided into a plurality of address electrode groups (Xa, Xb, Xc, and Xd) and, during the address period of at least one sub-field, the time point of the data pulses applied to the address electrodes belonging to at least one of the electrode groups is different from that of a scan pulse applied to the scan electrode Y. In addition, similar to the cases illustrated in FIGS. 8*a* to 8*c*, the width of the first sustain pulse applied during the sustain period is longer than another sustain pulse.

For example, as illustrated in FIG. 12*a*, assuming that a scan pulse is applied to the scan electrode Y at a time point ts, the data pulses applied to the electrodes belonging to each group, according to the arranged order of address electrode groups, are applied before and after the time point of a scan pulse application to the scan electrodes. In the case of the address electrodes ($Xa_1$ to $Xa_{n/4}$) belonging to the electrode group Xa, a data pulse is applied at a time point, which is $2\Delta t$ ahead of or prior to the application time point of the scan pulse applied to the scan electrode Y, i.e., at a time point $ts-2\Delta t$. In the case of the address electrodes ($Xb_{1+(n/4)}$ to $Xb_{2n/4}$) belonging to the electrode group Xb, a data pulse is applied at a time point, which is $\Delta t$ ahead of the scan pulse applied to the scan electrode Y, i.e., at a time point ts−Δt. In this way, to the address electrodes ($Xc_{(2n+1)/4}$ to $Xc_{3n/4}$) belonging to the electrode group Xc, a data pulse is applied at a time point ts+Δt, and to the address electrodes ($Xd_{1+(3n/4)}$ to $Xd_n$) belonging to the electrode group at a time point ts+2Δt. However, the application time point of a data pulse applied to the address electrodes of at least one electrode group among the plural electrode groups may be set to come behind that of the scan pulse applied to the scan electrode Y as illustrated in FIG. 12*b*.

Alternatively, the application time points for the data pulses applied to each electrode groups may be after the application time point of the scan electrode as illustrated in FIG. 12*b*, or all the data pulse application time points may precede the application time point of the scan electrode as illustrated in FIG. 12*c*. In FIGS. 12 *b* and 12*c*, all the application time points of the data pulse are set to come before or after that of the scan pulse, however, the application time point of a data pulse applied to the address electrodes belonged to only one address electrode group among the plural address electrode groups may be set to be before or after that of the scan pulse. That is, the number of address electrode groups, of which application time point are set behind and/or ahead of the scan pulse, may vary.

In the this embodiment, like the previous embodiment discussed above, in addition to the application time points of the data pulse applied to the address electrodes during the address period of at least one sub-field are different from the application time point of a scan pulse applied during the address period, the width of the scan pulses applied to the scan electrodes during a predetermined number of the sub-fields is wider than that of the scan pulses applied in the remaining sub-fields.

As described above, within one sub-field, the application time point of a data pulse may be set up to differ from that of a scan pulse applied to the scan electrode. Alternatively, with respect to and within one frame, the application time point of a scan pulse and a data pulse applied respectively to the scan electrode Y and the address electrodes X1 to Xn or the address electrode groups Xa, Xb, Xc and Xd can be set to be different from one another, and simultaneously, within each respective sub-field, the application time point of a data pulse applied to the address electrodes may be establish so as to differ from each other. This driving waveform is illustrated in FIG. 13.

Figure 13:
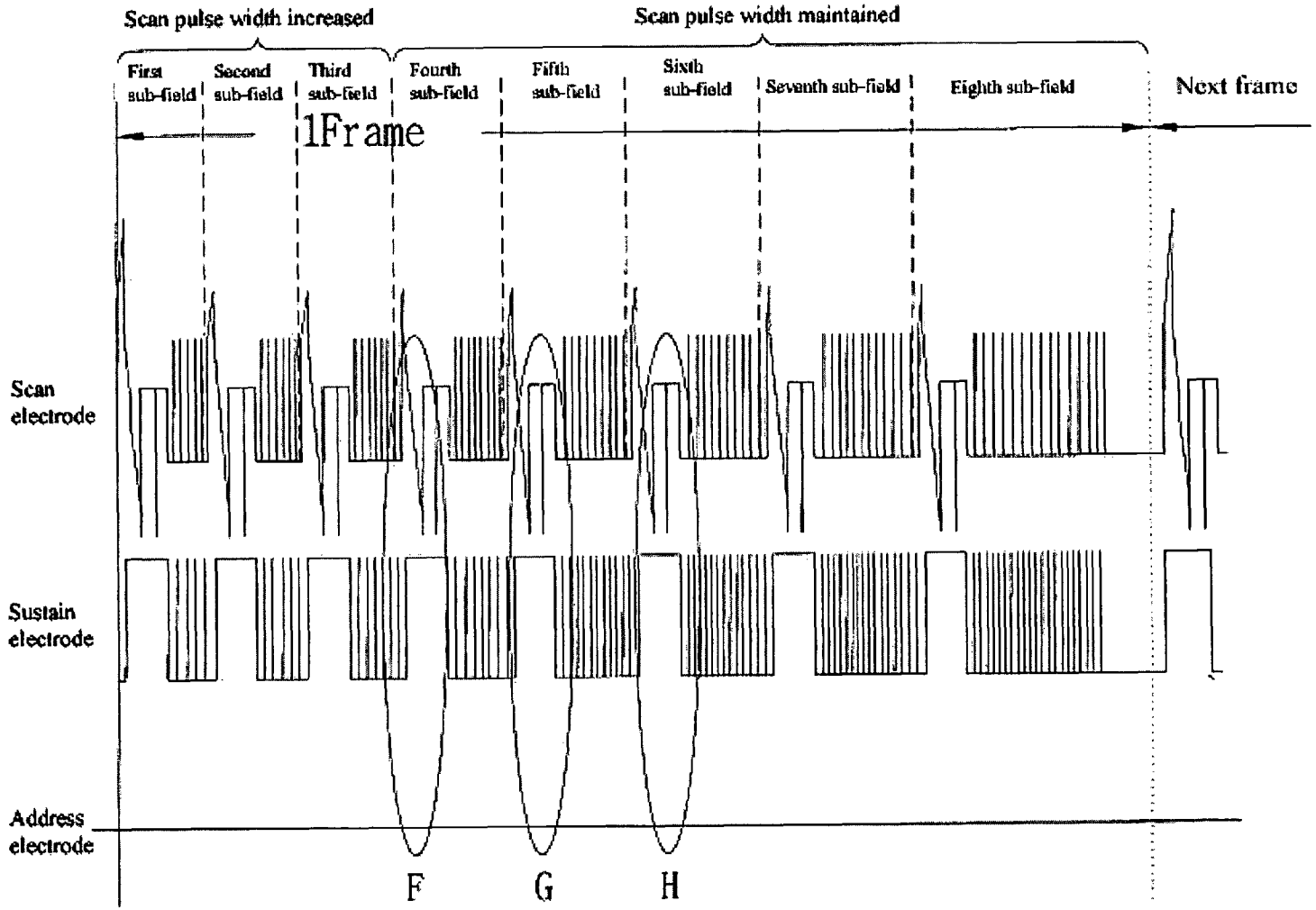
FIG. 13 illustrates driving waveforms according to the present invention.

FIG. 13 illustrates exemplary waveforms for driving a plasma display panel according to the invention. As illustrated in FIG. 13, specifically, regions F, G, and H, within a frame various methods of driving the panel may be utilized during the various sub-fields. For example, in the fourth sub-field the plasma display panel is driven as illustrated in FIG. 8*a*. In this case, the application time points of the data pulses applied to the data electrodes $X_1$ to $X_n$ are set to be before and after the application time point of a scan electrode, as discussed above with respect to FIG. 8*a*. However, in the fifth sub-field, illustrated in region G, the panel is driven as illustrated in FIG. 8*b*. In this case, the application time points of the data pulses are all set to be after the application time point of the scan pulse as discussed above with respect to FIG. 8*b*. Finally, in the sixth sub-field the panel is driven as illustrated in FIG. 8*d*. In this case the application time points of the data pulses are all set to be prior to the application time point of the scan pulse as discussed above with respect to FIG. 8*d*.

Accordingly, address discharge occurring in the address period is stabilized, and reduction in driving efficiency of the plasma display panel is thus prohibited. Furthermore, in the initial sub-fields where the sustain period is relatively short, the pulse width of a scan pulse is set to be greater than that of a scan pulse applied during the remaining sub-fields. Thus, degradation due to address jitter can be prevented. As a result, a single scan mode in which the entire panel is scanned by a single driving unit is possible due to the fact that the address discharges are stabilized.

In the driving waveforms described above, the width of the scan pulse is controlled by differentiating the pulse width of the scan pulse on a sub-field basis within a frame. However, the widths of the scan pulses applied to the scan electrodes $Y_1$ to Ym (where, m is a positive integer) within a given sub-field may be set to be different from each other on an scan electrode to scan electrode basis as illustrated in FIG. 14.

Figure 14:
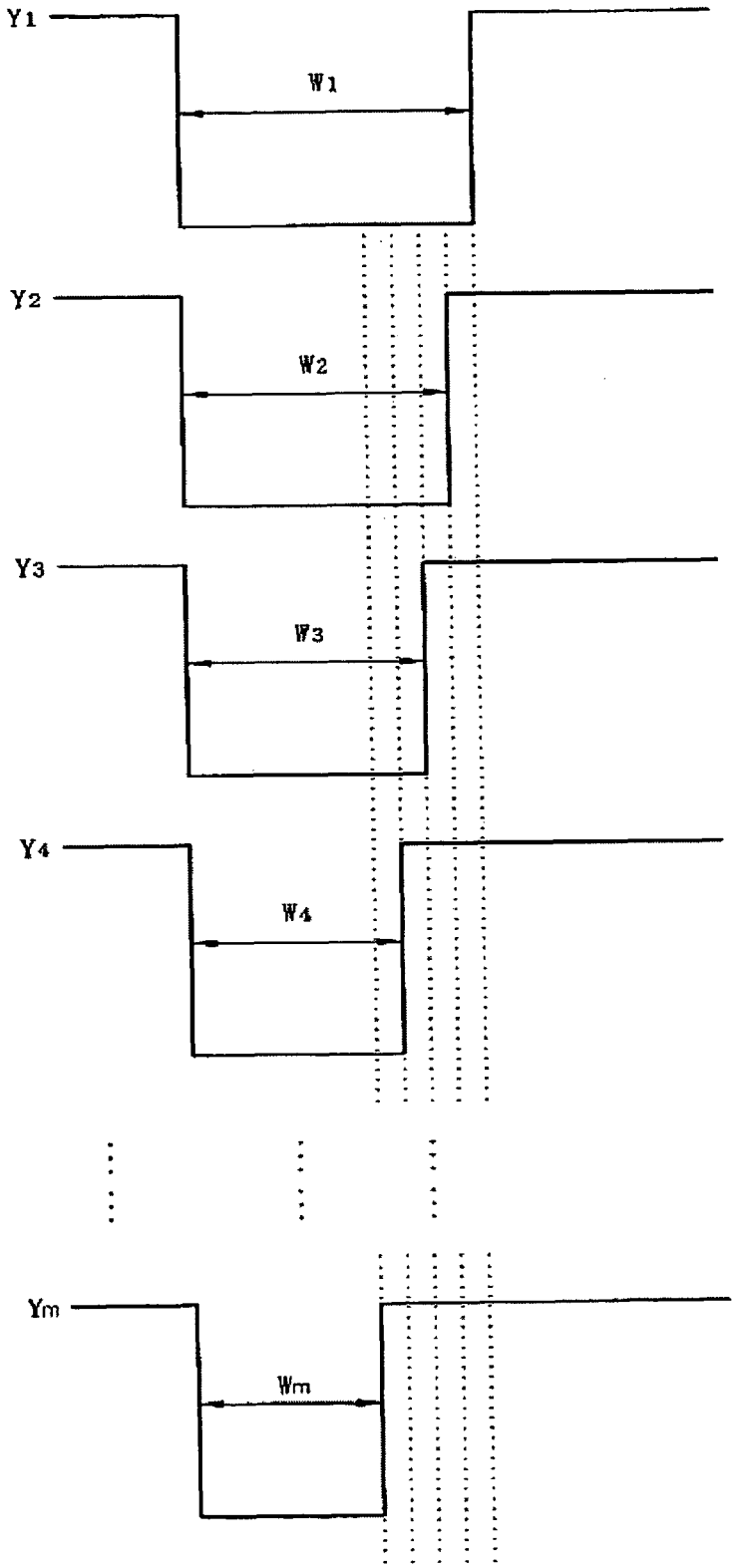
FIG. 14 illustrates driving waveforms according to the another embodiment of the present invention.

As illustrated in FIG. 14, the width of the scan pulses applied to each of the scan electrodes $Y_1$ to Ym during the address period of a predetermined number of the sub-fields are different from each other. More specifically, the width of the pulse applied to the scan electrodes decreases a predetermined amount between each adjacent electrode according the arrangement of the electrodes. Accordingly, scan electrode $Y_1$ is greater than scan electrode $Y_2$ which is greater than scan electrode $Y_3$ and so on until scan electrode $Y_m$. Because the scan pulses are sequentially applied to the scan electrodes, increasing the width of the scan pulses which are applied first improves the jitter characteristic during the address period of the sub-field. Although, the wide of each scan pulse is different in FIG. 14, only a predetermined number of the scan pulse may be increased in width, based on the jitter characteristic of the address discharge.

For example, as illustrated in FIG. 14, assuming that a pulse width of a scan pulse applied to the $Y_1$ scan electrode is $W_1$, a pulse width of a scan pulse applied to the $Y_2$ scan electrode is $W_2$, a pulse width of a scan pulse applied to the $Y_3$ scan electrode is $W_3$, a pulse width of a scan pulse applied to the $Y_4$ scan electrode is $W_4$, and a pulse width of a scan pulse applied to the $Y_m$ scan electrode is $W_m$, the relationship between the widths Wa−Wm is $Wm<W_4<W_3<W_2<W_1$. The range of the width of the scan pulses between the scan electrodes $Y_1$ to $Y_m$ is preferably about 1 to 3 times. For example, the pulse width $W_1$ of the scan pulse having the greatest width is preferably about 1 to 3 times the width of the smallest pulse width $W_m$, i.e., $W_m<W_1<3W_m$. This is due to the fact that both the duration time between a scan pulse and a data pulse, and the jitter characteristic of address discharge must be considered.

Furthermore, the change in the width ΔW of the scan pulse between each scan electrode can be constant, as illustrated in FIG. 14 or may vary.

For example, there is a case where an application time point of a data pulse and an application time point of a scan pulse are different from each other. In the above, there has been described a method in which data pulses are applied to all address electrodes $X_1$ to Xn at a time point different from that where a scan pulse is applied, or all the address electrodes are divided into four electrode groups having the same number of address electrodes in order of their arrangement and a data pulse is then applied on an electrode group basis at a time point different from that where the scan pulse is applied. However, there is another method in which in a state where odd-numbered address electrodes among all the address electrodes $X_1$ to Xn are set to one electrode group, and even-numbered address electrodes among the address electrodes $X_1$ to Xn are set to the other the electrode groups, the data pulse is applied to all the address electrodes within the same electrode group at the same time point, and an application time point of the data pulse of each of the electrode groups is different from that where the scan pulse is applied.

Furthermore, there is alternate method in which the address electrodes $X_1$ to Xn are divided into a plurality of electrode groups one or more of which have a different number of the address electrodes, and the data pulse is applied on an electrode group basis at a time point different from that where the scan pulse is applied. For example, assuming that an application time point of a scan pulse applied to the scan electrode Y is ts, a data pulse can be applied to an address electrode $X_1$ at a time point ts+Δt, data pulses are applied to address electrodes $X_2$ to $X_{10}$ at ts+3Δt, and data pulses can be applied to address electrodes $X_{11}$ to Xn at ts+4Δt. As such, the method of driving the plasma display panel according to the present invention can be modified in various manners.

As described above, according to the present invention, application time points of data pulses and the width of a scan pulse, which are applied to address electrodes in an address period, are controlled. Therefore, noise of waveforms applied to a scan electrode and a sustain electrode is reduced, degradation in address jitter characteristics is prevented, and address discharge is thus stabilized. Therefore, the present invention is advantageous in that it can stabilize driving of a panel and can thus increase driving efficiency.

It will be apparent to those skilled in the art that various modifications and variation can be made in the present invention without departing from the spirit or scope of the invention. Thus, it is intended that the present invention cover the modifications and variations of this invention provided they come within the scope of the appended claims and there equivalents.

What is claimed is:

1. A method for driving a plasma display panel, the plasma display panel including a plurality of scan electrodes, a plurality of address electrodes crossing the plurality of scan electrodes, and controller for driving the panel, the method comprising:

dividing the plurality of address electrodes into a plurality of address electrode groups;

applying a scan pulse to each of the plurality of scan electrodes in accordance with a scan sequence during an address period of a plurality of sub-fields; and applying a data pulse to each of the plurality of address electrode groups in association with a scan pulse, wherein a starting time point of the data pulse for at least one of the plurality of address electrode groups is different from that for the other address electrode groups during an address period of at least one of the sub-fields, wherein the width of the scan pulses applied to a predetermined number of the plurality of scan electrodes during an address period of at least one sub-field is greater than the width of the scan pulses applied to the remaining scan electrodes, wherein a starting time point of a scan pulse is offset from all of the starting time points of data pulses that are applied to the plurality of address electrode groups, wherein the width of the scan pulses applied to the predetermined number of the plurality of scan electrodes is gradually reduced from the first scan electrode, and wherein the difference between the widths of the scan pulses applied to the first scan electrode and an adjacent second scan electrode is the same as the difference between the widths of the scan pulses applied to the second scan electrode and an adjacent third scan electrode.

2. The method as claimed in claim 1, wherein the predetermined number of the scan electrodes are first in the scan sequence.

3. The method as claimed in claim 1, wherein the width of a scan pulse with the greatest width is in the range of 1 to 3 times the width of the scan pulse with the smallest width.

4. A plasma display apparatus, comprising:

a plurality of scan electrodes;

a plurality of address electrodes crossing the scan electrodes;

a scan driver for driving the plurality of scan electrodes;

a data driver for driving the plurality of address electrodes; and a controller configured to:

apply a scan pulse, according to a scan sequence, to each of the plurality of scan electrodes during an address period of a plurality of sub-fields within a frame; and apply a data pulse to each of a plurality of data electrode groups in association with a scan pulse, wherein a starting time point of the data pulse for at least one of the plurality of data electrode groups is different from that for the other data electrode groups during an address period of at least one of said plurality of sub-fields, where each of the plurality of data electrode groups includes one or more address electrodes, wherein the width of the scan pulses applied to a predetermined number of the plurality of scan electrodes during an address period of at least one sub-field is greater than the width of the scan pulses applied to the remaining scan electrodes, wherein a starting time point of a scan pulse is offset from all of the starting time points of data pulses that are applied to the plurality of data electrode groups, wherein the width of the scan pulses applied to the predetermined number of the plurality of scan electrodes is gradually reduced from the first scan electrode, and wherein the difference between the widths of the scan pulses applied to the first scan electrode and an adjacent second scan electrode is the same as the difference between the widths of the scan pulses applied to the second scan electrode and an adjacent third scan electrode.

5. The plasma display apparatus as claimed in claim 4, wherein the predetermined number of the scan electrodes are first in the scan sequence.

6. The plasma display apparatus as claimed in claim 4, wherein the width of a scan pulse with the greatest width is in the range of 1 to 3 times the width of the scan pulse with the smallest width.

* * * * *